US009914557B2

(12) United States Patent
Hopps

(10) Patent No.: US 9,914,557 B2
(45) Date of Patent: Mar. 13, 2018

(54) TOOTH PROTECTOR FOR BEVERAGE BOTTLE AND BEVERAGE BOTTLE ENCLOSURE

(71) Applicant: Krag David Hopps, Houston, TX (US)

(72) Inventor: Krag David Hopps, Houston, TX (US)

( * ) Notice: Subject to any disclaimer, the term of this patent is extended or adjusted under 35 U.S.C. 154(b) by 0 days.

(21) Appl. No.: 14/798,255

(22) Filed: Jul. 13, 2015

(65) Prior Publication Data

US 2015/0314915 A1 Nov. 5, 2015

Related U.S. Application Data

(63) Continuation of application No. 13/471,447, filed on May 14, 2012, now Pat. No. 9,248,938, which is a
(Continued)

(51) Int. Cl.
*B65D 23/08* (2006.01)
*B65D 23/14* (2006.01)
(Continued)

(52) U.S. Cl.
CPC ..... *B65D 23/08* (2013.01); *B65D 23/14* (2013.01); *B65D 41/20* (2013.01); *B65D 47/103* (2013.01); *B65D 47/40* (2013.01); *B65D 51/24* (2013.01)

(58) Field of Classification Search
CPC ..... B65D 23/08; B65D 23/14; B65D 47/40; B65D 47/103; B65D 41/20; B65D 51/24
(Continued)

(56) References Cited

U.S. PATENT DOCUMENTS 1,891,794 A * 12/1932 Bobrick ..... B65D 47/06 215/387
2,259,856 A * 10/1941 Moore ..... B65D 1/023 215/321
(Continued)

FOREIGN PATENT DOCUMENTS

CA 476789 9/1951
JP 57-117348 U 7/1982
(Continued)

OTHER PUBLICATIONS

Alpha Packaging (St. Louis, MO), "Anatomy of a Bottle", webpages from http:// www. alphap. com/basics/anatomy.html last accessed May 12, 2012. 11 pages.
(Continued)

*Primary Examiner* — Fenn C Mathew
*Assistant Examiner* — Madison L Poos
(74) *Attorney, Agent, or Firm* — Gordon G. Waggett, P.C.

(57) ABSTRACT

Tooth protector devices are disclosed for attachment to the top of a bottle to provide protection against injury, including chipping of teeth that can occur during drinking from a glass bottle. One embodiment comprises a concentric sleeve with top lip for insertion over the end of a bottle. Sleeve inner portion is adapted for engaging the bottle outer surface to hold the sleeve in place. The outer and top portions of the sleeve protect the consumer from the top edge of the bottle. When installed, a tooth protector according to the present invention cushions the teeth and mouth from any blunt force or impact that can occur when a bottle is hit or knocked. Also disclosed is a beverage cap with cushioned outer and upper surfaces that remain in place on the beverage bottle after opening the bottle to protect the consumer, and another bottle enclosure without such cushioned surfaces.

15 Claims, 22 Drawing Sheets

Related U.S. Application Data continuation-in-part of application No. 12/362,487, filed on Jan. 29, 2009, now Pat. No. 8,177,085.

(51) Int. Cl.

| | |
|---|---|
| ***B65D 41/20*** | (2006.01) |
| ***B65D 51/24*** | (2006.01) |
| ***B65D 47/10*** | (2006.01) |
| ***B65D 47/40*** | (2006.01) |

(58) Field of Classification Search

USPC .... 215/43–45, 228, 230, 255, 387; 220/351, 220/703, 711–713, 716–718, 780, 794; 426/106

See application file for complete search history.

(56) References Cited

U.S. PATENT DOCUMENTS

| | | | | |
|---|---|---|---|---|
| 2,317,046 | A | 4/1943 | Fleming | |
| 2,678,142 | A | 5/1954 | Creed | |
| 3,317,087 | A * | 5/1967 | Landis | B65D 47/265 206/427 |
| 3,349,949 | A | 10/1967 | Brown et al. | |
| 3,595,421 | A * | 7/1971 | Sanchis | B65D 47/06 215/309 |
| 4,037,746 | A | 7/1977 | Ver Hage | |
| 4,694,970 | A | 9/1987 | Hayes | |
| 5,613,616 | A * | 3/1997 | Monus | B65D 17/165 215/354 |
| 5,749,491 | A | 5/1998 | Wylder et al. | |
| 6,277,422 | B1 * | 8/2001 | Gale | B65D 51/24 220/212 |
| 7,686,182 | B1 * | 3/2010 | Shukri | B65D 47/0823 215/387 |
| 2008/0149650 | A1 * | 6/2008 | Kim | A47G 19/2216 220/716 |
| 2008/0272084 | A1 * | 11/2008 | Lohrman | B29C 45/16 215/255 |
| 2010/0186755 | A1 | 7/2010 | Hopps | |
| 2011/0024381 | A1 | 2/2011 | Frishman | |
| 2012/0132556 | A1 * | 5/2012 | Webster | A45F 5/02 206/438 |

FOREIGN PATENT DOCUMENTS

| | | | |
|---|---|---|---|
| JP | 08-004430 | Y2 | 2/1996 |
| JP | 2004-338724 | A | 12/2004 |

OTHER PUBLICATIONS

Alpha Packaging (St. Louis, MO), "Neck Know How", webpages from http:// www. alphap. com/basics/neck.html last accessed May 12, 2012. 18 pages.

Alpha Packaging (St. Louis, MO), "Glossary", webpages from http:// www. alphap. com/basics/glossary.html last accessed May 12, 2012. 6 pages.

Wikipedia, "Beer Bottle", webpage from http:// en. wikipedia. org/wiki/Beer_bottle, last accessed, Mar. 15, 2012, 6 pages.

Wikipedia, "Beverage Can", webpage from http:// en. wikipedia. org/wiki/Beverage_can, last accessed, Mar. 23, 2012, 7 pages.

Undated photo of prior art aluminum can with pull tab openable top, 1 page.

Servipac (Henrietta, NY), "Coloured Tamper Evident Shrink Bands and Shrink Seals", webpages from http:// www.servipak. com/ colouredshrinkbands.htm, last accessed, Mar. 23, 2012, 4 pages.

Millercoors LLC (Chicago, IL), Image of Coors Light® brand beer bottle from http:// www. millercoors. com/Our-Beers/Great-Beers. aspx?brand=17_511, last accessed Jan. 21, 2013, 1 page.

Anheuser-Busch Incorporated (St. Louis, MO), Image of Bud Light® brand beer bottle from http:// anheuser-busch. com/index. php/our-beers/#!BudLightFamily, and "Bud Light Download High Res Images" tab, last accessed Jan. 21, 2013, 3 pages.

Hopps, David Krag, PCT Notification of Transmittal of the International Search Report and Written Opinion, PCT/US2013/04095 (Aug. 20, 2013). 2 Pages.

Hopps, David Krag, PCT International Search Report, PCT/ US2013/04095 (Aug. 20, 2013). 3 Pages.

Hopps, David Krag, PCT Written Opinion, PCT/US2013/04095 (Aug. 20, 2013). 10 Pages.

* cited by examiner

TOOTH PROTECTOR FOR BEVERAGE BOTTLE AND BEVERAGE BOTTLE ENCLOSURE

CROSS-REFERENCE TO RELATED APPLICATIONS

This application is a continuation and claims the benefit of priority of co-pending U.S. application Ser. No. 13/471,447, entitled "Tooth Protector for Beverage Bottle and Beverage Bottle Enclosure" filed May 14, 2012, which is a continuation-in-part and claims the benefit of priority of U.S. application Ser. No. 12/362,487, entitled "Tooth Protector", filed Jan. 29, 2009, now U.S. Pat. No. 8,177,085, issuing May 15, 2012, the disclosures of which are considered part of and are incorporated by reference in their entirety in the disclosure of this application.

STATEMENT REGARDING FEDERALLY SPONSORED RESEARCH OR DEVELOPMENT

Not Applicable.

BACKGROUND OF THE INVENTION

Field of the Invention

The present invention generally relates to a device for attachment to the top of the bottle to provide protection against injury to teeth when drinking from the bottle. The present invention also relates to a bottle enclosure device for attachment to the top of the bottle to provide protection against injury to teeth when drinking from the bottle after the bottle top enclosure is opened.

Description of the Prior Art

It is a well-known fact that drinking a beverage from a glass bottle (or bottle made of other hard material, such as metal, hard plastic or high stiffness material), implicates the risk of damage to the teeth of the person consuming the beverage. Such damage may, for example, range from relatively minor chipping of the tooth which requires restoration to more pronounced damage which requires tooth replacement. The risk of tooth damage from drinking from a glass bottle is heightened when it is done in a public location such as a bar or sporting event and particularly when the beverage being consumed is an alcoholic beverage.

As presently exists, the conventional crimped cap or twist off cap is used to contain the contents inside a bottle, whereas upon removal of the crimped cap to consume a bottle's contents the consumer is exposed to a glass, or otherwise hard surface of which when in contact with a consumer's mouth may cause dental damages.

U.S. Pat. No. 2,317,046 (Fleming) relates to a sanitary drinking cap for 'bottles and the like, and has for one of its objects the production of a simple and efficient cap which may be easily attached to the mouth of a bottle to facilitate drinking from a bottle, and at the same time shield the lips of the user so that the end of the bottle neck will be prevented from contacting with the lips of the user. A further object of Fleming is the production of a simple and efficient sanitary drinking cap having an inserting neck for fitting within the neck of a bottle and an overhanging or encasing flange for encasing the outer bead of the neck of a bottle to provide a sanitary shield for the bottle neck while drinking, the inner neck and outer bead providing a brace for firmly holding the drinking cap upon a bottle. Fleming expressly teaches that attached to the top portion of the bottle protector is a drinking spout which extends outwardly at different heights from the top (outer wall) of the protector. Similarly, U.S. Pat. No. 2,678,142 (Creed) discloses a removable mouthpiece or spout for a bottle, where like with Fleming, there is a trough-like tongue (spout) structure extending outwardly at different heights from the top (outer wall) of the mouthpiece. However, it is desired to have a tooth protector device that does not have such outwardly-extending structure.

No device has heretofore been available to protect a person's teeth when he/she is drinking from a glass bottle, nor has a bottle top enclosure been provided that provides the feature of protecting a person's teeth when drinking from the opened bottle where the bottle top enclosure, when opened, does not have outwardly-extending structure. This new and useful result has been obtained by the tooth protectors and bottle top enclosures of the present invention.

SUMMARY OF THE INVENTION

Applicant's co-pending U.S. application Ser. No. 12/362,487 filed Jan. 29, 2009, issuing as U.S. Pat. No. 8,177,085 on May 15, 2012 discloses a tooth protector for a bottle (e.g., such as a glass bottle), provided to aid in the prevention of teeth being broken or chipped when a person is consuming liquid from the bottle. A tooth protector in accordance with applicant's co-pending U.S. application Ser. No. 12/362,487 comprises a monolithic structure for insertion into the mouth of the bottle, and the monolithic structure comprises inner, outer and top portions. The inner and outer portions comprise substantially concentric structures which define an annulus between them for engaging the mouth of the bottle. The top portion of the tooth protector joins the inner and outer portions, and the outer portion and the top portion respectively provide protection to the consumer's teeth from the top part of the neck and the top edge of the bottle when the tooth protector is inserted into the mouth of the bottle. The top portion defines a horizontal plane across the width of the protector. Unlike the Fleming prior art device, the protector of the present invention does not comprise structure that extends above the horizontal plane. In one embodiment, the inner portion of the tooth protector comprises an inner face having a bulge to prevent the tooth protector from leaking while the liquid contents of the bottle are being consumed. In this embodiment, the inner portion of the tooth protector also comprises an outer face which is tapered to squeeze the inner portion of the tooth protector tightly against the bottle.

A tooth protector bottle sleeve in accordance with the present invention may be fabricated from rubber or soft plastic (to provide a cushioning surface when consuming the contents from the bottle) and it may further comprise a clip for attachment of the tooth protector to a keychain or similar structure.

In the new disclosure in the present application, there is described a protective drinking cap device used as an attachment to the top portion of a bottle to facilitate user safety by eliminating dental health vulnerability from direct contact with a bottle to a consumer's mouth. The drinking cap device provides a consumer with improved comfort during use, and provides an alternative for cap material with the intent of replacing the existing conventional crimped metal cap. The protective drinking cap comprises: soft material, similar to rubber, with a low stiffness covering the outer neck and top edge of a bottle; an adequate surface area protecting and covering the top portion of a bottle commonly coming into contact with a consumer's mouth during consumption; a wall thickness providing substantial cushioning from the soft material essential for reducing the effects from bottle impact against a consumer's mouth; and a cushioning texture to create a soft surface by utilizing low stiffness material to improve consumer comfort. One embodiment of the protective drinking cap device is as a sleeve that fits over the top of an opened bottle to provide cushioning to protect the consumer from damaging a tooth caused by impacting his or her teeth on the top lip of the bottle. Another embodiment of the protective drinking cap device incorporates the outer protective sleeve into the permanent bottle enclosure, providing a bottle enclosure with soft outer surfaces wherein the bottle enclosure may be opened to access the contents of the bottle while maintaining the protective cushioning layer in place.

The present disclosure's sleeve design and features include a structure to protect a consumer from impact of a bottle and provide a means to safely and securely seal the contents in a bottle (including these safety features) during manufacturing, shipping, and distributing. The present invention includes a protective drinking cap for attachment to the top, open end of a bottle with the intent to protect a consumer and provide a cushioning surface for improved comfort during consumption of the contents inside a bottle or drinking container, by way of covering the outside surface of a bottle or container commonly coming into contact with a consumer's mouth. A bottle or drinking container can be a conventional glass bottle or other hard material formed to create a container used to enclose a liquid content from which a consumer drinks.

The present protective drinking cap provides a protective surface and seals the top lip of the bottle thereby enabling the consumer to consume the contents of the bottle after opening without impeding the flow of the contents exiting the bottle. The present tooth protector sleeve is provided with adequate length, wall thickness, and material cushioning to protect the consumer's teeth from impact inflicting dental damages. The present invention relies on the interaction of the external shape of the bottle and internal shape of the tooth protector sleeve to adequately seal and provide strength and attachment of the sleeve to the bottle.

Most companies rely on some form of conventional crimped cap to seal the contents of a bottle but none provide the consumer with protection once the cap is removed enabling consumption of the contents while also providing protection against accidental tooth damage. Most glass bottles are relative in shape and size of the opening whereas the conventional crimped cap can be replaced with the combination beverage bottle enclosure and tooth protector. Although there are caps with relative shape and size, none are structured such that the consumer can benefit from a proactive surface and/or material to enable them with the necessary protection and comfort during use. The present drinking cap includes a smooth and round edge to overlap the top of a bottle and outer surface to eliminate sharp edges and provide a rounded surface. The material forming the body of the invention has an adequate stiffness that maintains sufficient form.

In addition, there is a mechanism incorporated in the design of the present invention which enables a consumer to open the bottle and then consume the beverage with the benefit of an outer protective cushioning already in place. The removable portion to open the contents may consist of an adequate circumference to expose the inner diameter equivalent to the inner diameter of the bottle, thus enabling the contents to flow from a bottle without impacting the flow of the contents out of a bottle. The removable portion may consist of the same material properties as the protective portion or otherwise material properties required for adequate sealing and providing safety measures. The removable portion includes, but is not limited to, a structure by which a consumer can pull or push or modify the opening to expose the contents for consumption. This structure has similar features such as a ring upon which a consumer can exert a force necessary to open the contents.

The bottle cap enclosures of the present disclosure may be designed to meet any applicable FDA or other requirements for sealing beverages, including sealing carbonated beverages under sufficient pressure required for beverage bottles.

The bottle cap enclosures of the present invention can also include tamper resistant seals and tamper evident seals to provide visible evidence of entry.

The seals created on the beverage bottles can be achieved by any applicable sealing technology, including the ability for induction sealing.

The present invention is directed to a tooth protector comprising a monolithic structure for attachment to a top of a bottle, the bottle having a neck section comprising a top edge defining a mouth opening into the bottle and a top outer section extending downwardly from the top edge, the bottle neck top outer section further comprising one or more circumferential protrusions for engaging the protector defining a bottle neck outer surface profile. In this embodiment, the tooth protector comprises an open-ended concentric outer sleeve having an outer surface with top end and bottom end, an internal surface for mating with the bottle top outer section, and top lip portion extending radially inwardly from the top end of the outer sleeve a distance sufficient to cover the bottle top edge. The top lip has an outer edge defining an aperture opening coaxial with the bottle mouth opening when the sleeve is attached over the bottle neck section. The top lip has a top side and an underside, the top lip underside creating a seal across the bottle top edge when the protector is attached over the bottle neck section. The sleeve outer portion defines an overall protector width, the sleeve outer and top portions respectively providing protection from the top section of the neck and the top edge of the bottle when the tooth protector is inserted over the mouth of the bottle. In this embodiment, the sleeve top portion defines a horizontal plane across the width of the protector and the protector not comprising structure that extends above horizontal plane.

In another embodiment, the tooth protector, the one or more bottle circumferential protrusions comprise a circumferential flange located proximate the mouth of the bottle, the flange having an outer flange surface, a top flange edge and a bottom flange edge, the sleeve internal surface further comprising a circumferential groove for mating with the circumferential flange, the groove having a top edge and a bottom edge, the groove snapping into place over the flange to secure the protector in position on the bottle.

In another embodiment of the tooth protector, the one or more bottle circumferential protrusions comprise a circumferential bead located on the bottle top outer section, the bead having an outer bead surface, a top bead edge and a bottom bead edge, the sleeve internal surface further comprising a circumferential groove for mating with the circumferential bead, the groove having a top edge and a bottom edge, the groove snapping into place over the flange to secure the protector in position on the bottle.

In yet another embodiment of the tooth protector, the one or more bottle circumferential protrusions comprise: (a) a circumferential flange located proximate the mouth of the bottle, the flange having an outer flange surface, a top flange edge and a bottom flange edge, the sleeve internal surface further comprising a first circumferential groove for mating with the circumferential flange, the groove having a top edge and a bottom edge, the groove snapping into place over the flange to secure the protector in position on the bottle; and (b) a circumferential bead located on the bottle top outer section below the flange, the bead having an outer bead surface, a top bead edge and a bottom bead edge, the sleeve internal surface further comprising a second circumferential groove for mating with the circumferential bead, the groove having a top edge and a bottom edge, the groove snapping into place over the flange to secure the protector in position on the bottle.

In one embodiment, the protector inner portion comprises at least one circumferential groove for snapping into interference fit engagement with a corresponding one of the one or more bottle circumferential protrusions to secure the protector in position on the bottle.

In another embodiment, the protector inner portion comprises three circumferential protrusions for snapping into interference fit engagement with a corresponding one or more of the one or more bottle circumferential protrusions to secure the protector in position on the bottle.

In yet another embodiment, the protector inner portion comprises a surface profile that engages, in mated relationship, the bottle surface profile.

In still another embodiment of the present disclosure, the one or more bottle circumferential protrusions comprise threads, the sleeve internal surface further comprising a circumferential groove for mating with the threads, the groove having a top edge and a bottom edge, the groove snapping into place over the threads to secure the protector in position on the bottle.

Additionally, the one or more bottle circumferential protrusions may comprise threads, the sleeve internal surface further comprising threads for engaging the bottle threads in threaded connection to secure the protector in position on the bottle.

The tooth protectors of the present invention may be constructed of any suitable material, such as rubber or soft plastic.

The tooth protectors may employ a clip on the outer portion.

Also disclosed herein is a beverage bottle cap enclosure featuring a tooth protector for attachment to a top of a bottle, the bottle having a neck section comprising a top edge defining a mouth opening into the bottle and a top outer section extending downwardly from the top edge, the bottle cap enclosure capable of being installed in sealed fashion over the top of a bottle, the bottle having an interior space containing a beverage. In this embodiment, the enclosure comprises a concentric outer sleeve having an outer surface with top end and bottom end, an internal surface for mating with the bottle top outer section, and a top lip portion extending radially inwardly from the top end of the outer sleeve a distance sufficient to cover the bottle top edge, the top lip having an outer edge defining an aperture opening coaxial with the bottle mouth opening when the sleeve is attached over the bottle neck section. The enclosure further comprises a removable seal member comprising a removable membrane attached along the top lip outer edge to form a membrane interface, the membrane having a membrane outside face facing outward of the bottle, and a membrane inside face facing the interior space of the bottle, and a ring pull structure attached to the membrane outside face for removing the membrane prior to permit access to the beverage contained in the bottle. In this embodiment, the sleeve top lip has a top side and an underside, the top lip underside creating a seal across the bottle top edge when the enclosure is attached over the top of the bottle. The sleeve outer portion defines an overall protector width. The sleeve outer and top portions respectively provide protection from the top section of the neck and the top edge of the bottle when the enclosure is mounted over the mouth of the bottle, and the seal has been opened to permit consumption of the beverage.

In the beverage bottle enclosure, the outer sleeve may be fabricated from rubber, soft plastic or other suitable material. Likewise, the bottle enclosure may be constructed from any suitable material.

If desired for increased structural support, the beverage bottle enclosure outer sleeve, removable membrane and ring pull may be structurally reinforced.

The beverage bottle enclosure may also further comprise a tamper evident or tamper proof seal.

In another embodiment of the beverage bottle enclosure, the enclosure further comprises an inner concentric portion having upper end and lower end, the upper end attached to the top lip outer edge and extending downwardly, the inner and outer concentric portions comprising substantially concentric structures which define an annulus between them for engaging the mouth of the bottle and the top lip portion, the inner concentric portion forming an apertured opening, the removable membrane being attached along the inner concentric portion lower end to create a membrane interface, the removable seal member being recessed within the inner concentric portion.

The beverage bottle enclosure of the present invention may be installed on a beverage containing bottle. As such, one embodiment of the present invention includes a bottle containing a beverage, wherein the bottle is sealed with a beverage bottle enclosure of the present disclosure. This sealed bottle will ideally employ a tamper evident or tamper proof seal.

In another aspect of the present disclosure, there is described a bottle cap enclosure for attachment to a top of a bottle, the bottle having a neck section comprising a top edge defining a mouth opening into the bottle and a top outer section extending downwardly from the top edge, the bottle cap enclosure capable of being installed in sealed fashion over the top of a bottle, the bottle having an interior space containing a beverage, the enclosure comprising: (a) a concentric outer sleeve having an outer surface with top end and bottom end, an internal surface for mating with the bottle top outer section, and a top lip portion extending radially inwardly from the top end of the outer sleeve a distance sufficient to cover the bottle top edge, the top lip having an outer edge defining an aperture opening coaxial with the bottle mouth opening when the sleeve is attached over the bottle neck section; (b) a removable seal member comprising a removable membrane attached along the sleeve outer edge to form a membrane interface, the membrane having a membrane outside face facing outward of the bottle, and a membrane inside face facing the interior space of the bottle, and a ring pull structure attached to the membrane outside face for removing the membrane prior to permit access to the beverage contained in the bottle. In this embodiment, the sleeve top lip has a top side and an underside, the top lip underside creating a seal across the bottle top edge when the enclosure is attached over the top of the bottle, the sleeve outer portion defining an overall protector width.

In another embodiment, the bottle cap enclosure further comprises an inner concentric portion having upper end and lower end, the upper end attached to the top lip outer edge and extending downwardly, the inner and outer concentric portions comprising substantially concentric structures which define an annulus between them for engaging the mouth of the bottle and the top lip portion, the inner concentric portion forming an apertured opening, the removable membrane being attached along the inner concentric portion lower end to create a membrane interface, the removable seal member being recessed, in whole or in part, within the inner concentric portion.

Furthermore, the protectors and bottle cap structures disclosed herein may contain advertising or promotional information displayed on their outer surfaces.

New Drawings

Figure 3A:
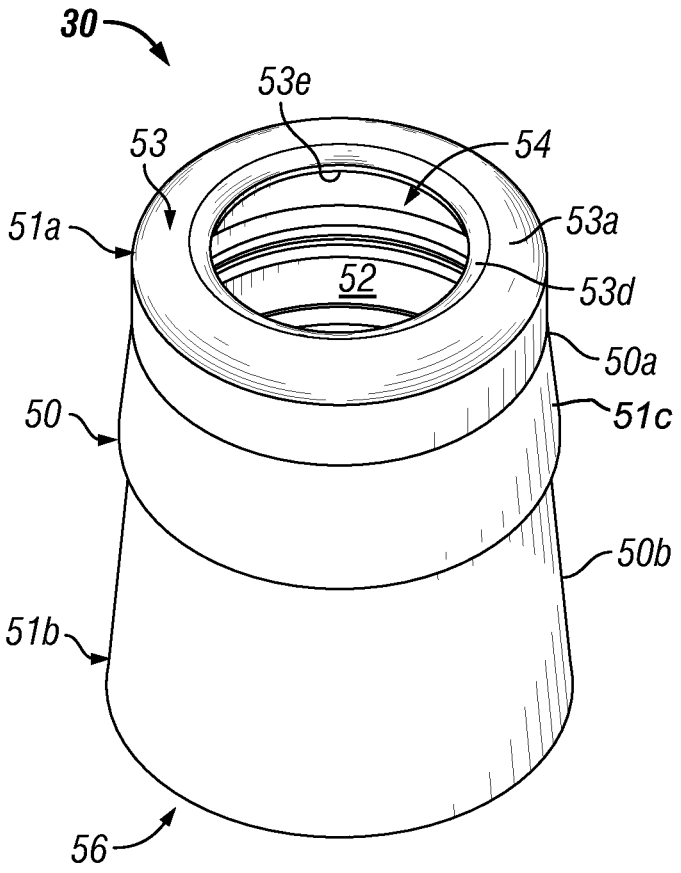

FIG. 3A is a perspective view of another embodiment of a tooth protector bottle sleeve.

Figure 3B:
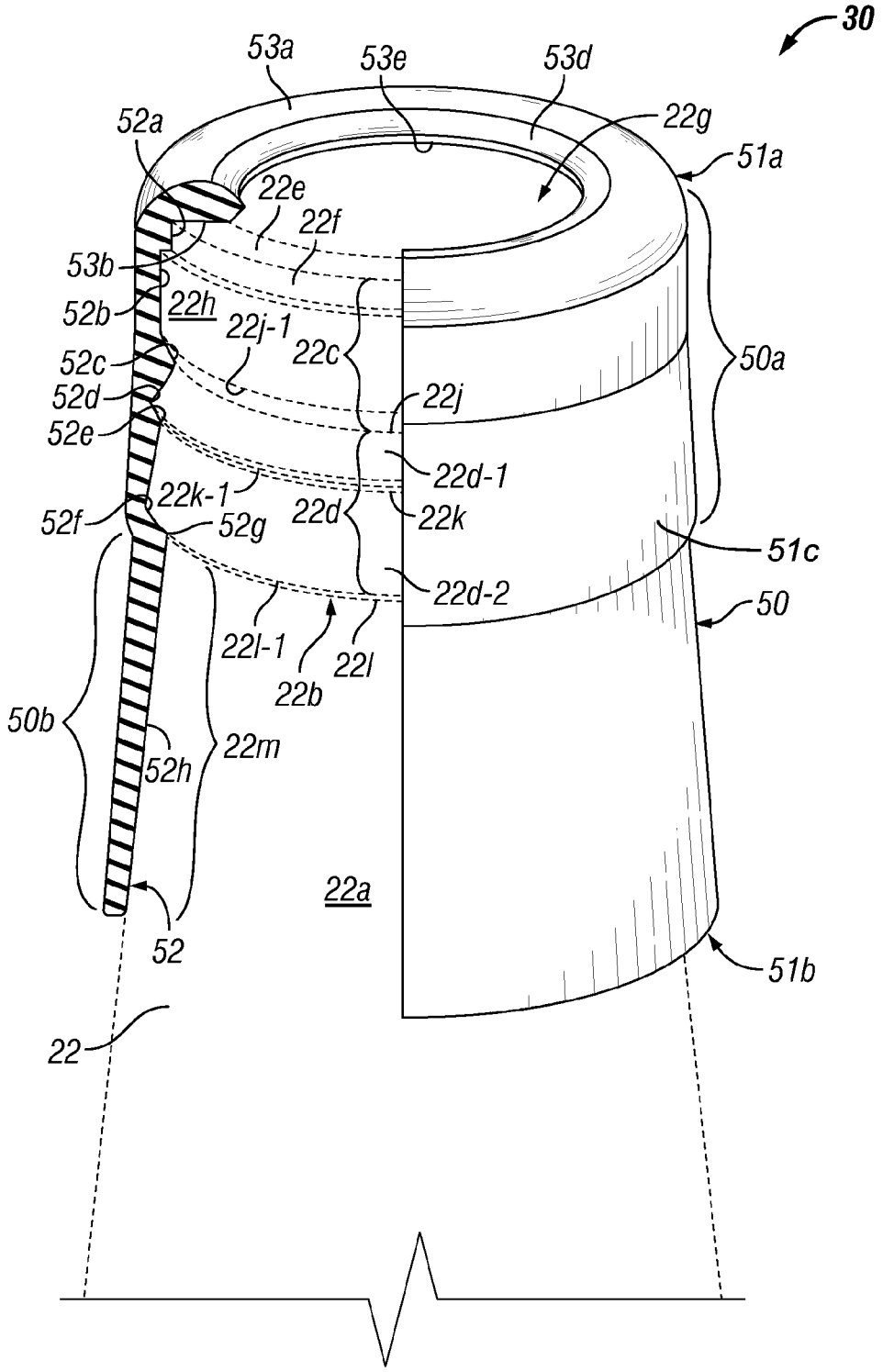

FIG. 3B is a cutaway perspective view of the tooth protector bottle sleeve of FIG. 3A shown on a bottle.

Figure 4:
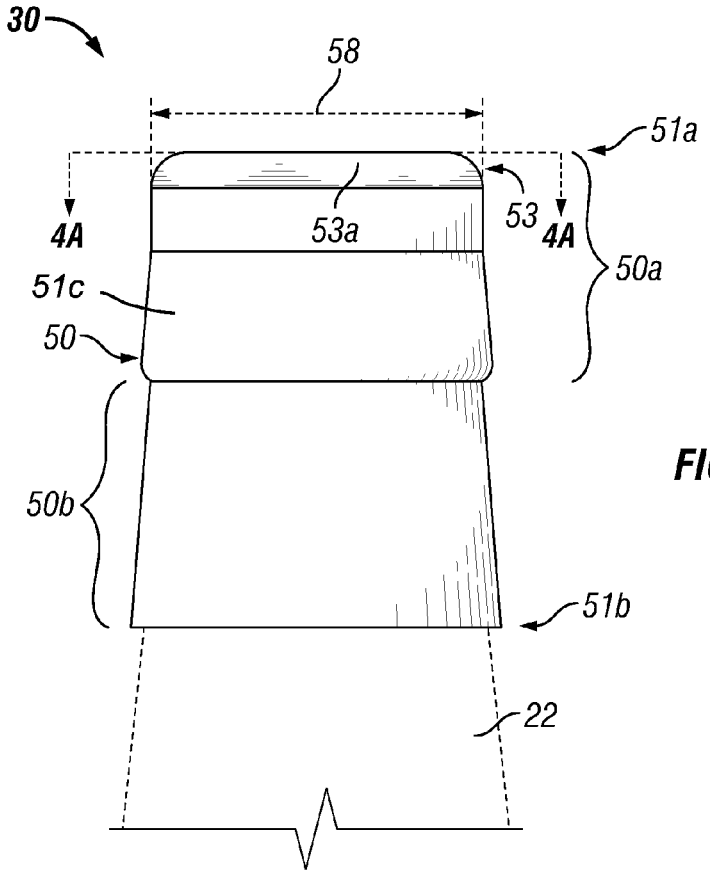

FIG. 4 is an elevation side view of the tooth protector bottle sleeve embodiment of FIG. 3A.

Figure 4A:
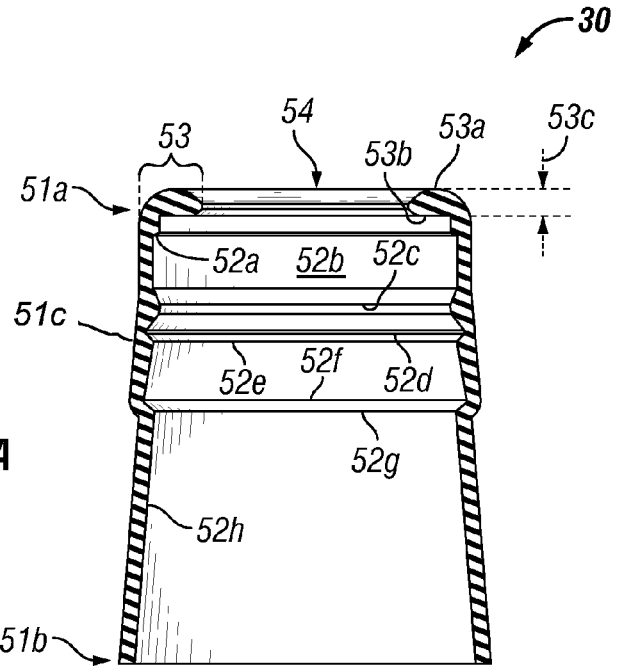
Figures 1, 4A:
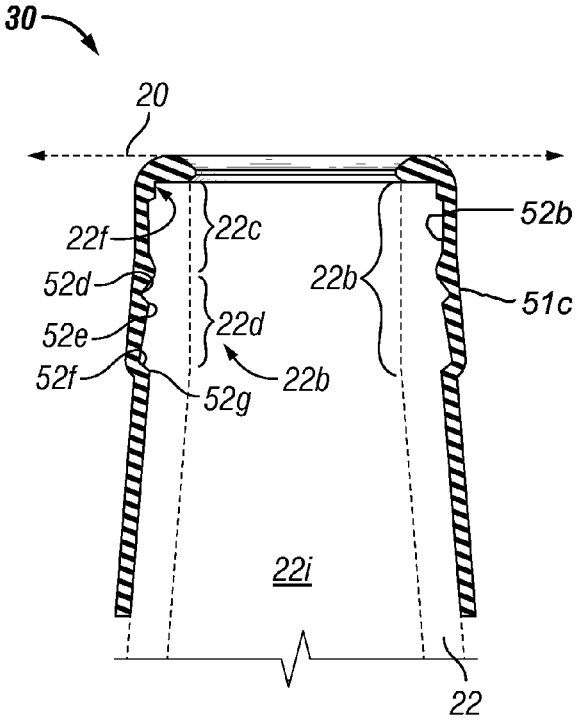
Figures 2, 4A:
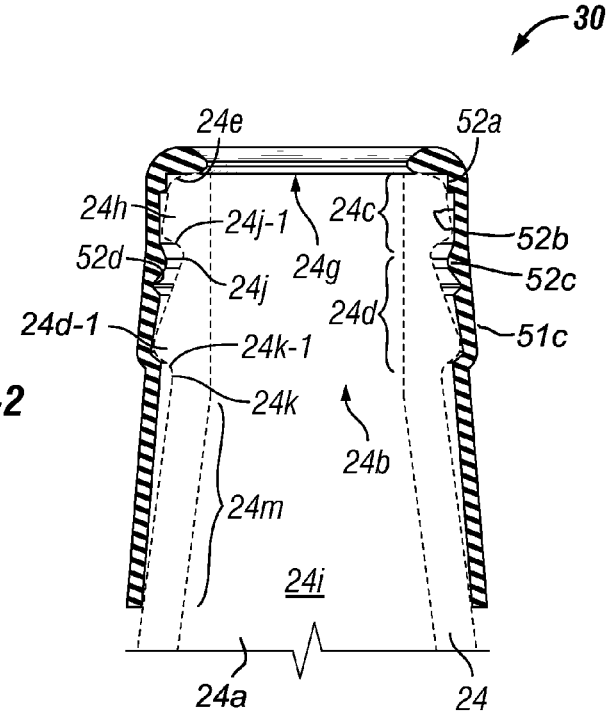

FIG. 4A is a longitudinal cross-sectional view of the tooth protector bottle sleeve of FIG. 4 taken along lines 4A-4A.

Figure 1:
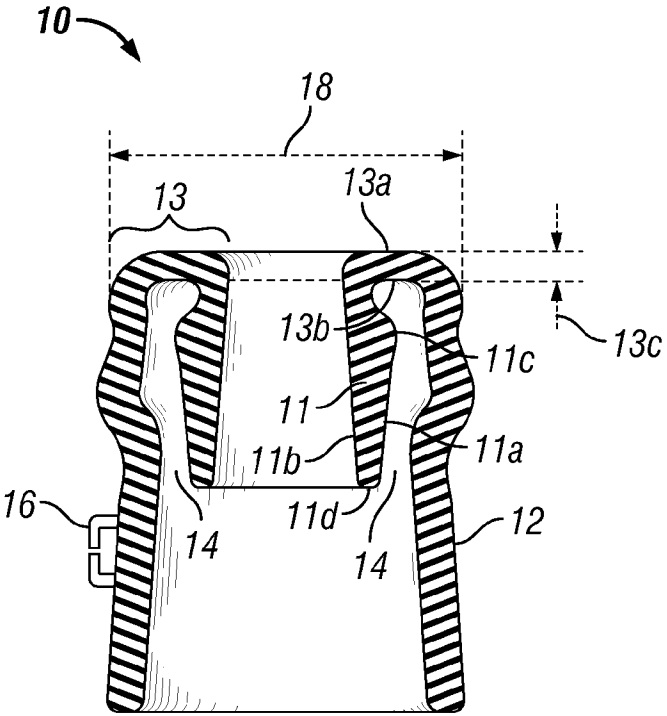
FIG. 1 is an elevation view in cross-section of one embodiment of a tooth protector in accordance with applicant's co-pending U.S. application Ser. No. 12/362,487 filed Jan. 29, 2009, issuing as U.S. Pat. No. 8,177,085 on May 15, 2012.

FIG. 4A-1 illustrates the longitudinal cross-sectional view of FIG. 4A wherein the tooth protector bottle sleeve is on a bottle (shown for environment) illustrating in this embodiment that the exterior contour of the bottle is of a shape that mates with substantially all of the inside contour of the sleeve.

Figure 2:
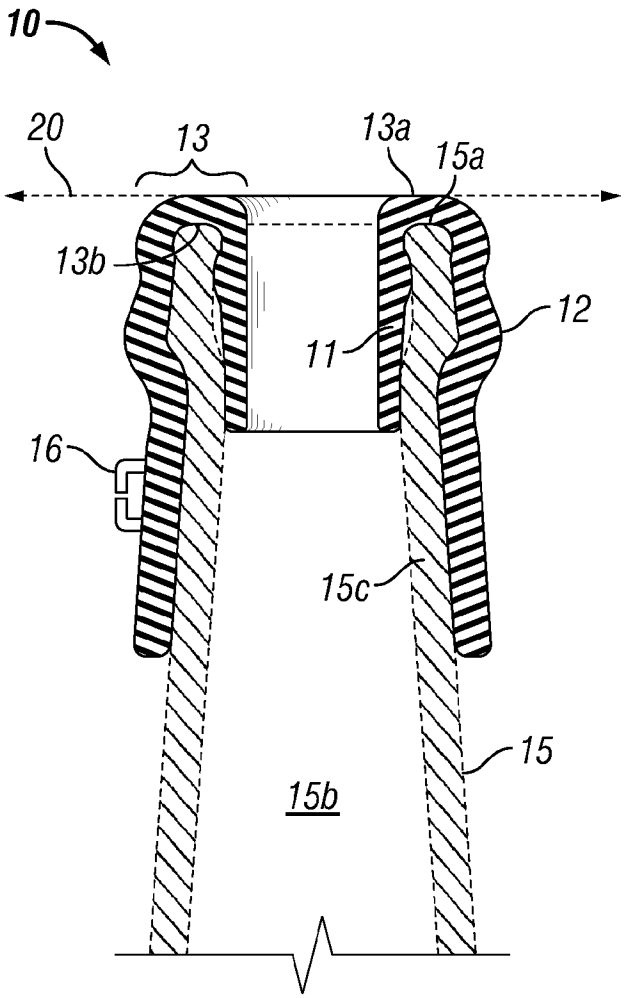
FIG. 2 is an elevation view in cross-section which illustrates the tooth protector of FIG. 1 installed in the mouth of a glass bottle in accordance with applicant's co-pending U.S. application Ser. No. 12/362,487 filed Jan. 29, 2009, issuing as U.S. Pat. No. 8,177,085 on May 15, 2012.

FIG. 4A-2 illustrates the longitudinal cross-sectional view of FIG. 4A wherein the tooth protector bottle sleeve is on a bottle (shown for environment) illustrating in this embodiment that the exterior contour of the bottle has a slightly different contour, but is still held in place by ridges on the inside of the sleeve. In this embodiment, the inside face of the sleeve has enough spaced-apart ridges that it can accommodate multiple bottle neck outer contours. The bottle lips are contained in the sleeve's recesses to hold the sleeve snugly in place and to create tight fit or seal around the upper drinking section of the bottle.

Figures 3, 4A:
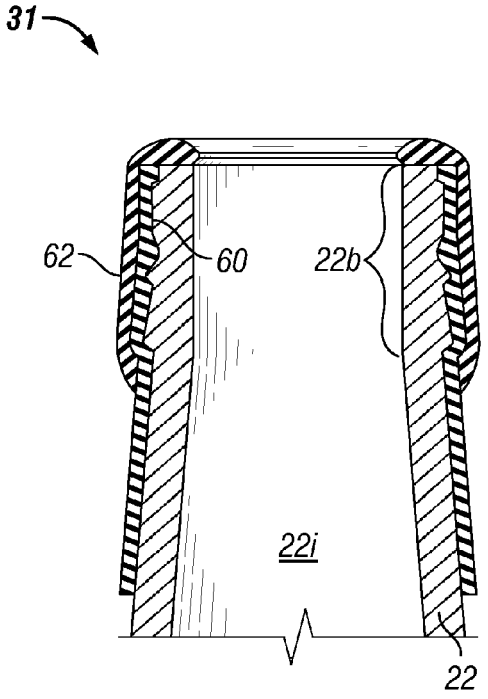
Figures 4, 4A:
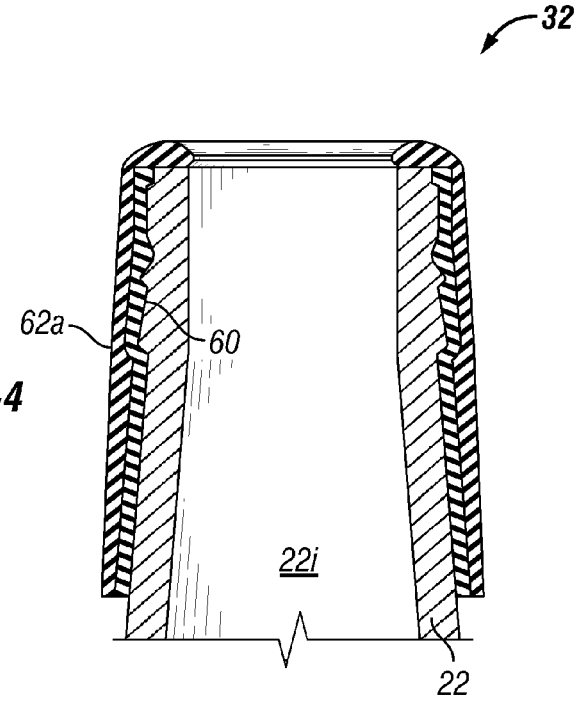

FIG. 4A-3 is an elevation view in longitudinal cross section of another embodiment of the present invention wherein the tooth protector bottle sleeve has been modified to represent a two-layer structure: the inner layer that mates with or that otherwise receives the bottle has more structural support while the outer layer that covers the top and top portions of the sides is a softer material.

FIG. 4A-4 is an elevation view in longitudinal cross section of another embodiment of the present invention much like in FIG. 4A-3 but wherein the exterior soft layer of the tooth protector sleeve extends down the length of the inner structural layer.

Figures 4, 4A, 5:
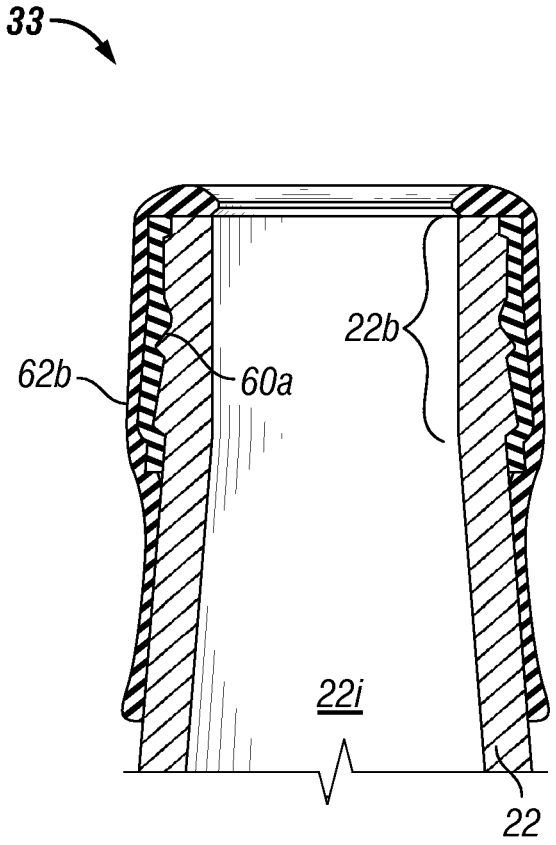
Figure 5:
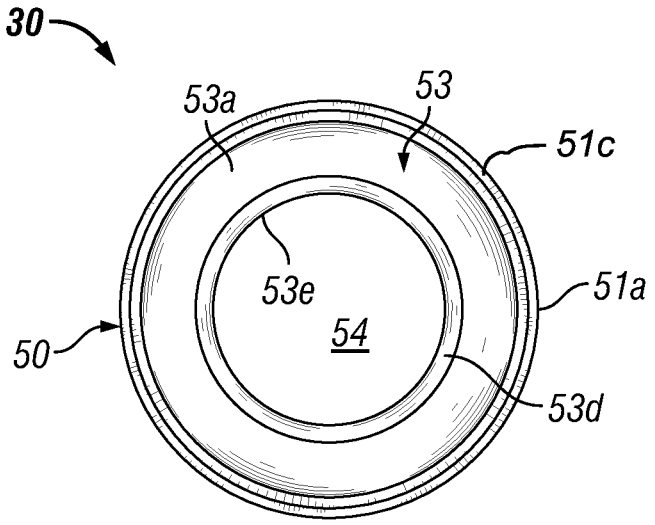

FIG. 4A-5 is an elevation view in longitudinal cross section of another embodiment of the present invention much like in FIG. 4A-3 but wherein the interior layer of the tooth protector sleeve mates with the top section of the bottle, and the exterior soft layer extends further downward than the interior layer.

FIG. 5 is a top view of the tooth protector shown in FIG. 3A.

Figure 6:
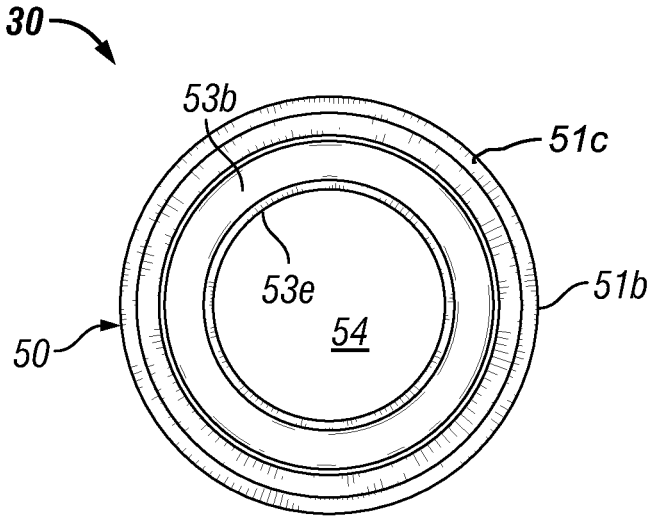

FIG. 6 is a bottom view of the tooth protector shown in FIG. 3A.

Figure 7:
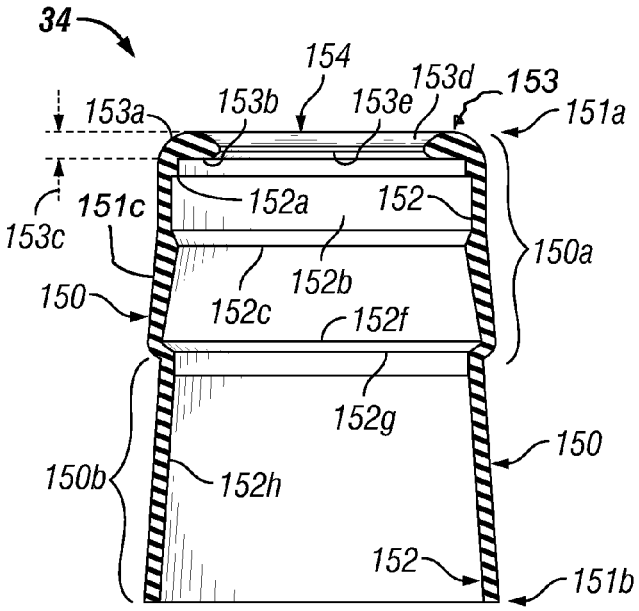

FIG. 7 is a longitudinal cross sectional view of another embodiment of the present invention similar to that of FIG. 4A except that the interior contours of the tooth protector bottle sleeve are different, i.e., customized for a particular bottle profile, such as here, for example, a BUD LIGHT® brand beer bottle (Anheuser-Busch Incorporated).

Figure 8:
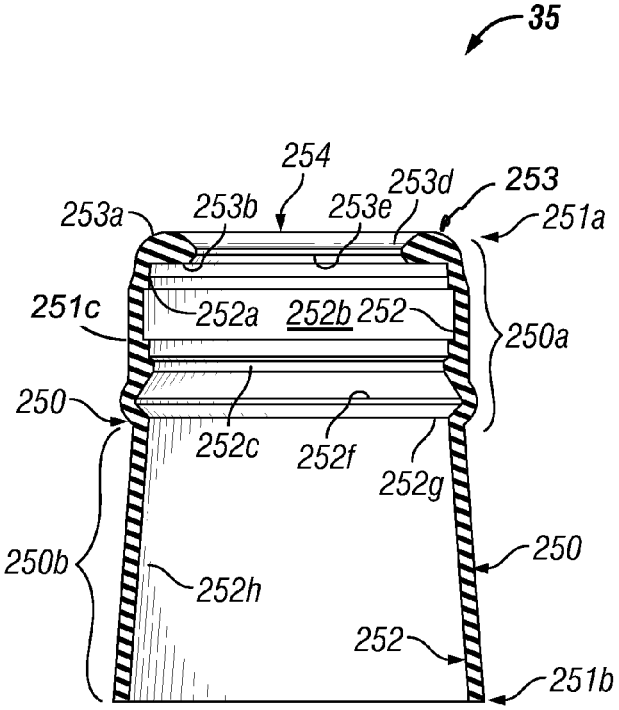

FIG. 8 is a longitudinal cross sectional view of another embodiment of the present invention similar to that of FIG. 4A except that the interior contours of the tooth protector bottle sleeve are different, i.e., customized for a particular bottle profile, such as here, for example, a COORS LIGHT® brand beer bottle (MillerCoors LLC).

Figure 9A:
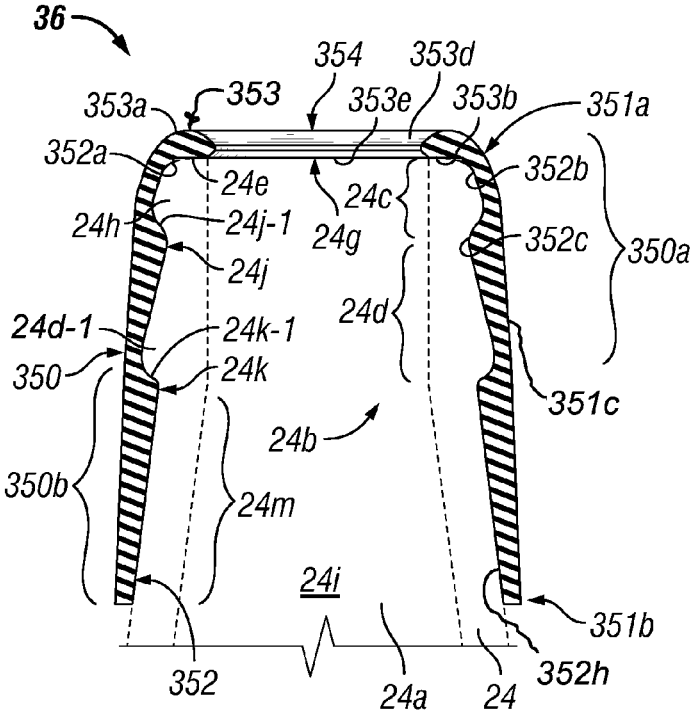

FIG. 9A is a longitudinal cross sectional view of another embodiment of the present invention similar to that of FIG. 4A except that the interior contours of the tooth protector bottle sleeve generally follow the contours of a standard beverage bottle neck, such as the bottle shown in environmental view.

Figure 9B:
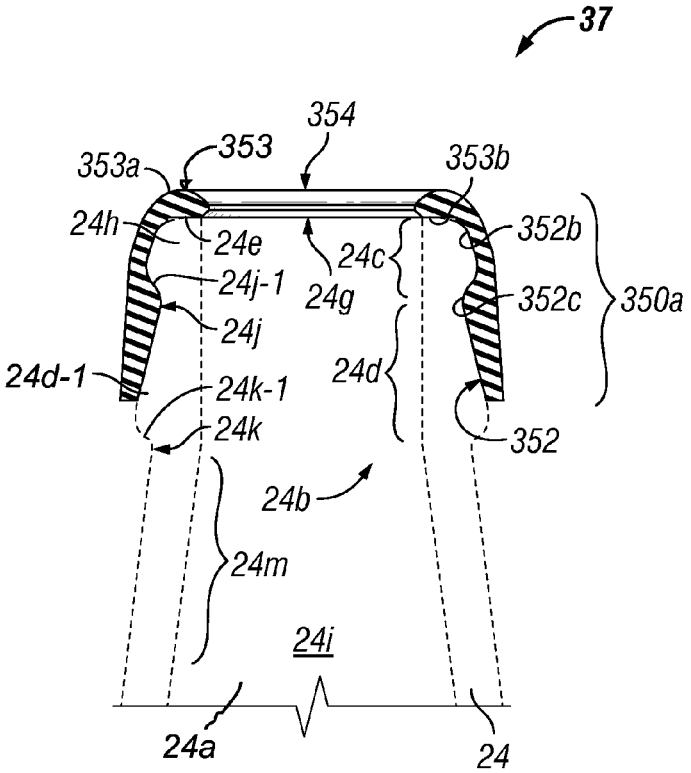

FIG. 9B is a longitudinal cross sectional view of another embodiment of the present invention similar to that of FIG. 4A except that the interior contours of the tooth protector bottle sleeve generally follow the contours of a standard beverage bottle neck, such as the bottle shown in environmental view, and the sides of the sleeve cover just the upper portion of the bottle.

Figure 10A:
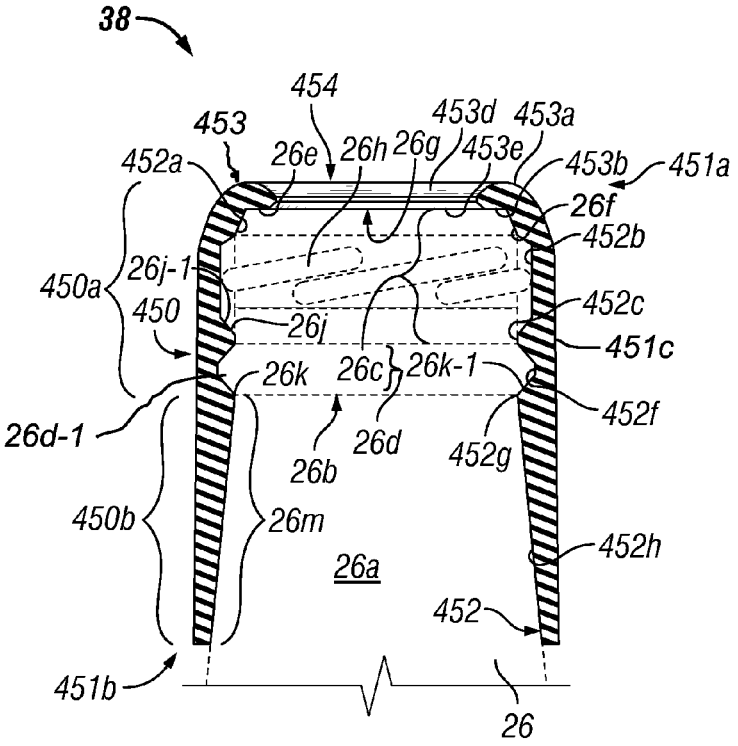

FIG. 10A is a longitudinal cross sectional view of another embodiment of the present invention similar to that of FIG. 4A except that the interior contours of the tooth protector bottle sleeve are configured to fit over a bottle employing a threaded top (the bottle being shown here in environmental view). In this embodiment, the sleeve is adapted to be installed on the top of an opened twist-off cap bottle or other bottle employing traditional threads where here, the primary force holding the sleeve in place is the snap lip interface below the threads.

Figure 10B:
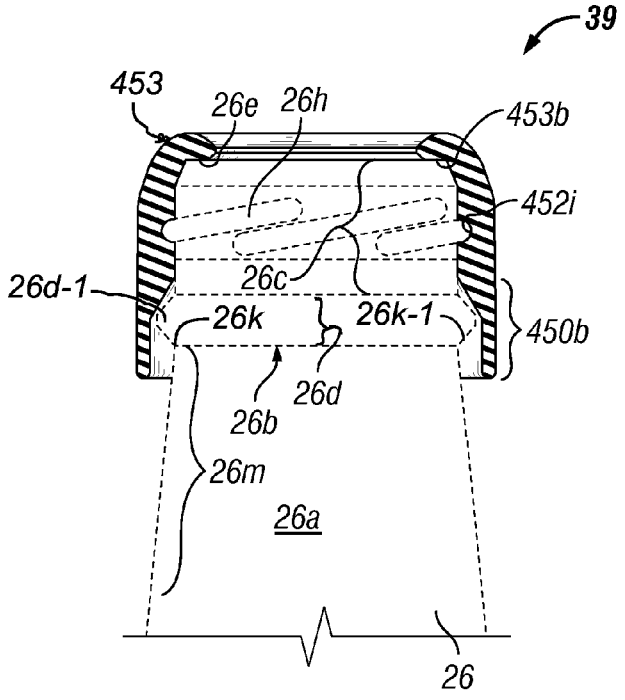

FIG. 10B is a longitudinal cross sectional view of another embodiment of the present invention similar to that of FIG. 10A except that the interior contours of the tooth protector bottle sleeve contain mated threads for engaging the threads on the bottle (shown in environmental view), and where the sides of the sleeve cover just the upper portion of the bottle.

Figure 11A:
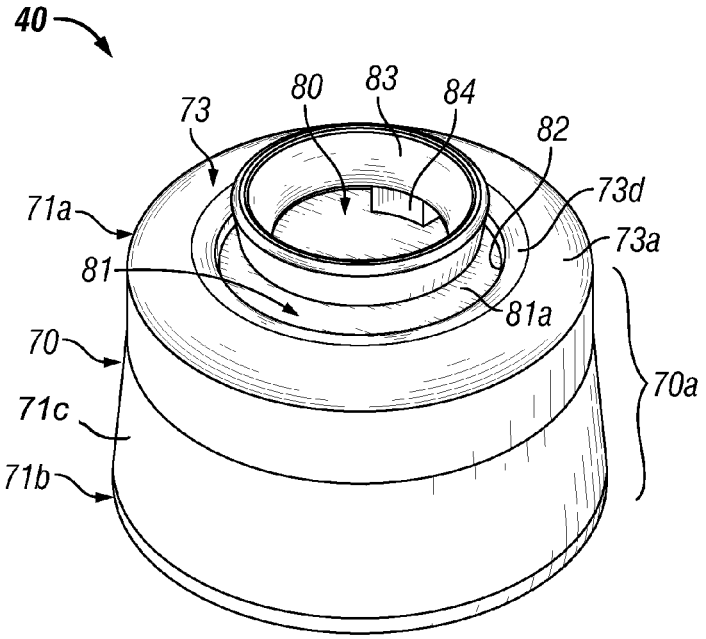

FIG. 11A is a perspective view of a combination bottle top enclosure and tooth protector according to another embodiment of the present disclosure.

Figure 11B:
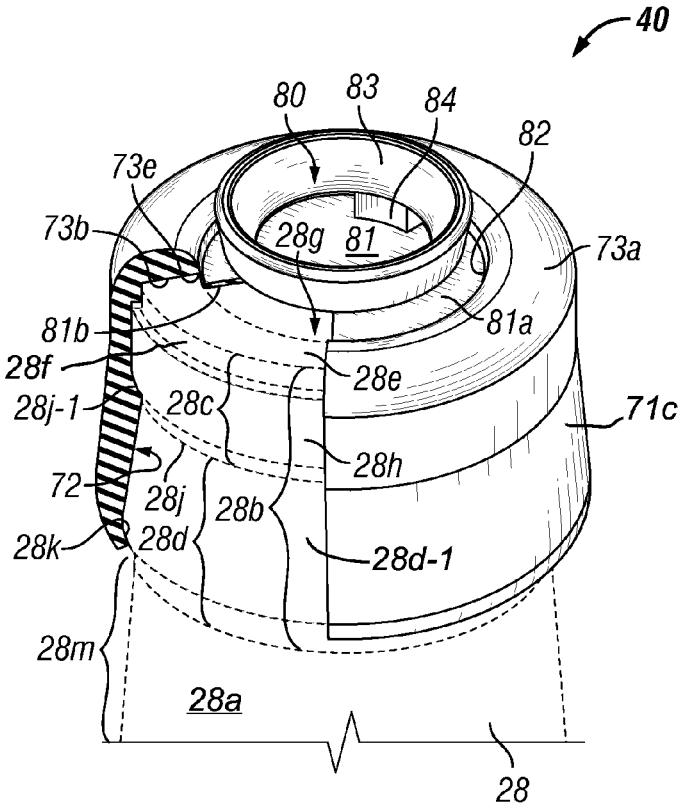

FIG. 11B is a cut-away sectional view of the bottle top enclosure and tooth protector of FIG. 11A shown installed on a bottle (shown in environmental view).

Figure 12:
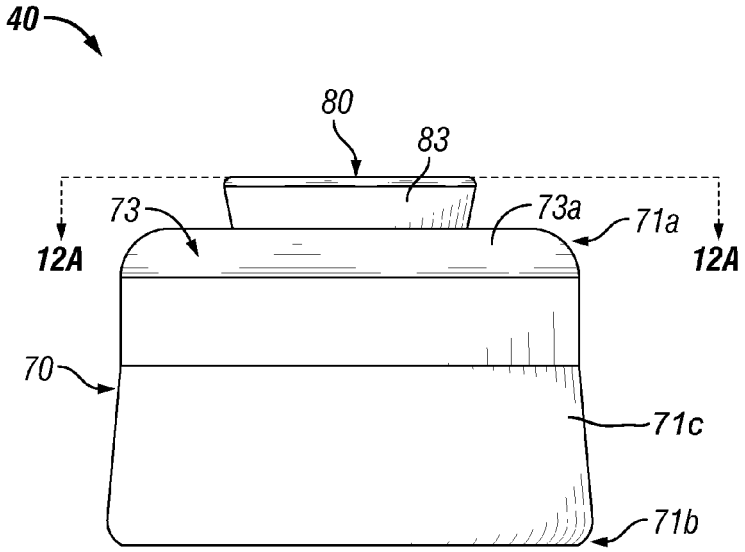

FIG. 12 is a side view of the combination bottle top enclosure and tooth protector illustrated in FIG. 11A.

Figure 12A:
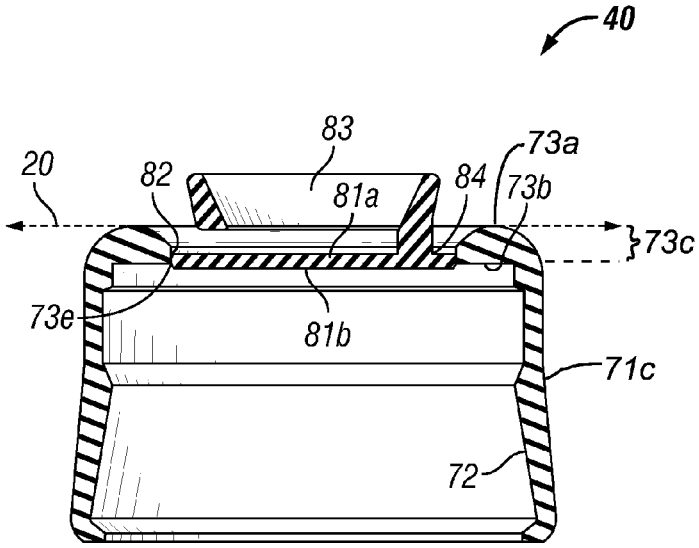
Figures 1, 12A:
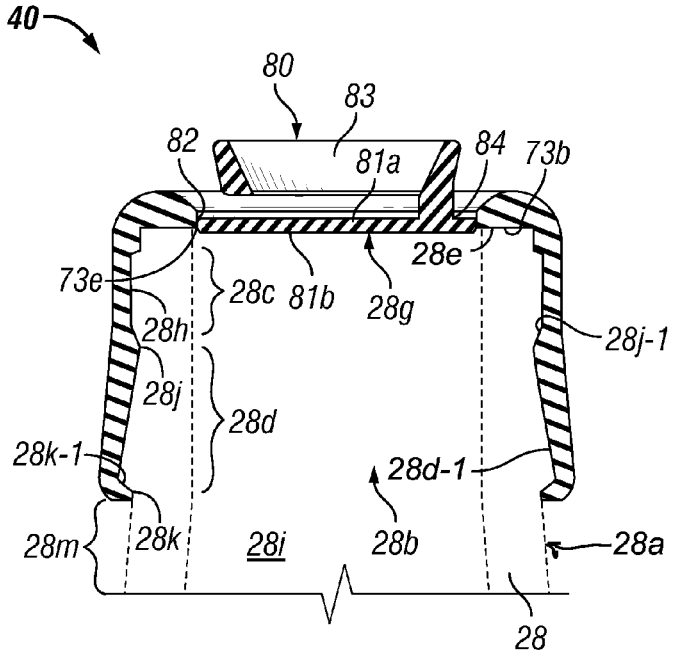
Figures 2, 12A:
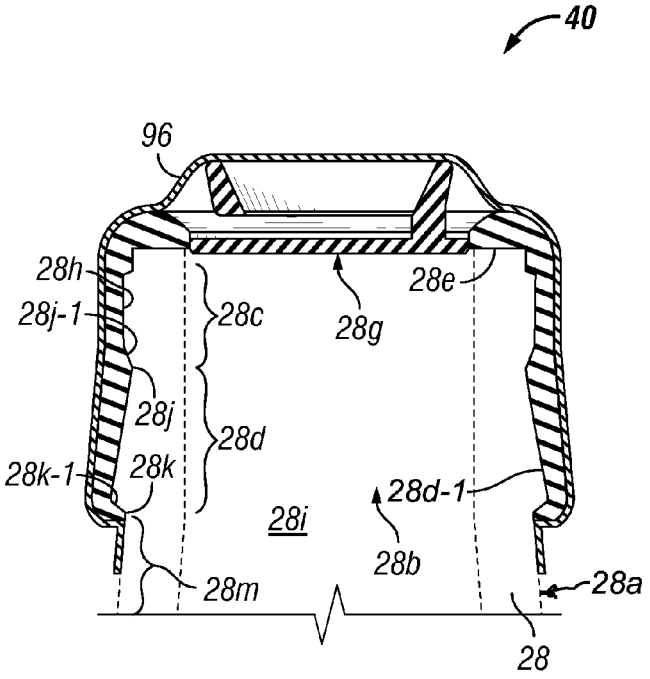
Figures 3, 12A:
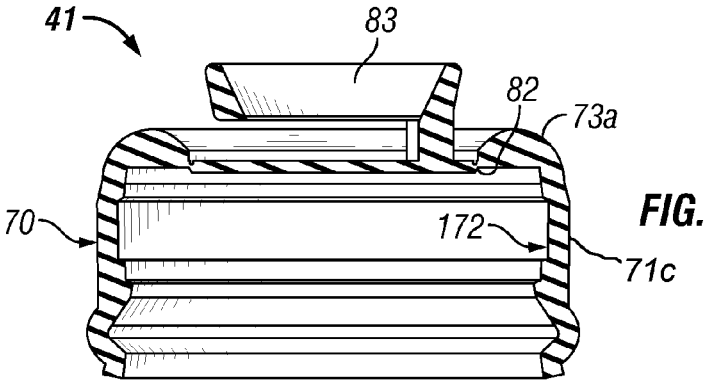

FIG. 12A is a longitudinal cross sectional view of the bottle top enclosure and tooth protector of FIG. 12 taken along lines 12A-12A.

FIG. 12A-1 is the cross sectional view of FIG. 12A illustrating the bottle top enclosure installed on a bottle (shown in environmental view).

FIG. 12A-2 is the cross sectional view of FIG. 12A-1 shown employing a removable protective covering, such as a shrink wrap type seal, installed over the bottle top enclosure.

FIG. 12A-3 is a longitudinal cross sectional view of another embodiment of the bottle top enclosure and tooth protector illustrating where the interior contour or profile of the bottle top enclosure is customized to fit the exterior contour or profile of the bottle.

Figure 13:
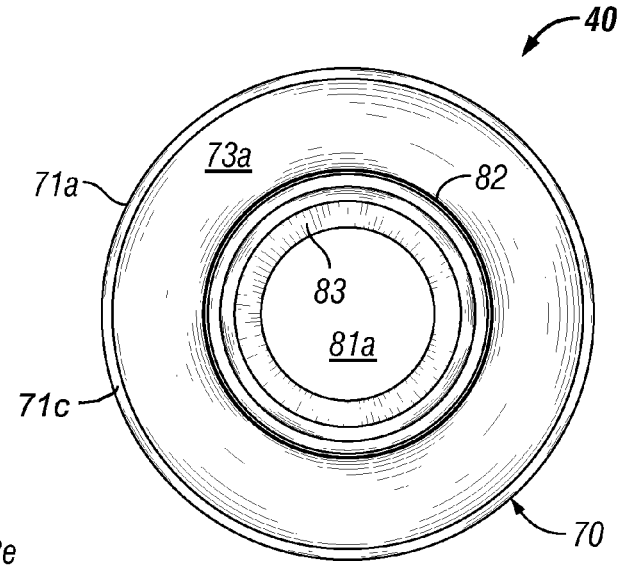

FIG. 13 is a top view of the combination bottle top enclosure and tooth protector illustrated in FIG. 11A.

Figure 14:
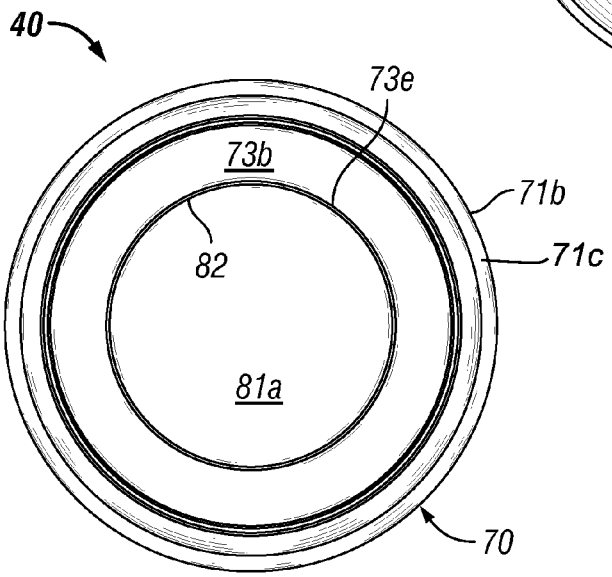

FIG. 14 is a bottom view of the combination bottle top enclosure and tooth protector illustrated in FIG. 11A.

Figure 15:
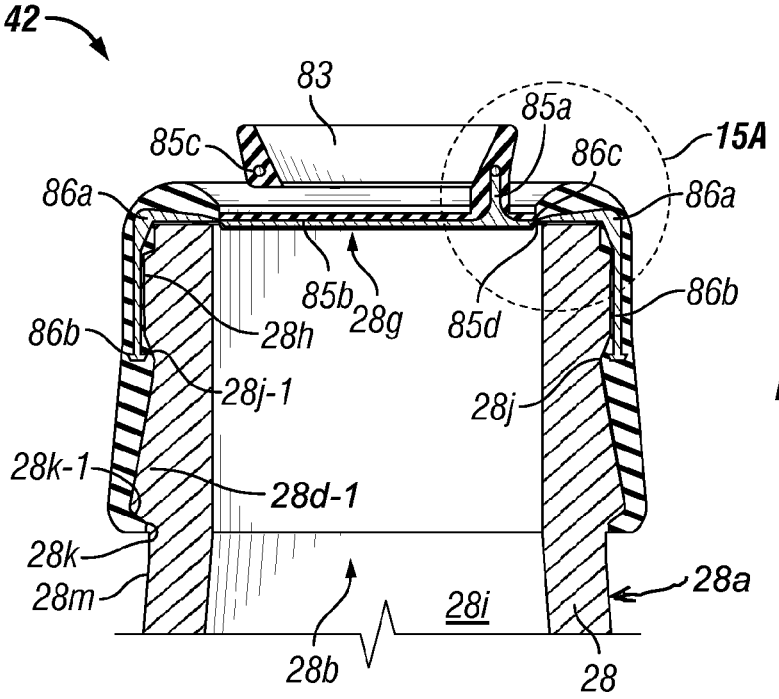

FIG. 15 is a longitudinal cross sectional view of a combination bottle top enclosure and tooth protector according to another embodiment of the present disclosure, similar to the view shown in FIG. 12A, except featuring internal reinforcement structures, e.g., made from metal.

Figure 15A:
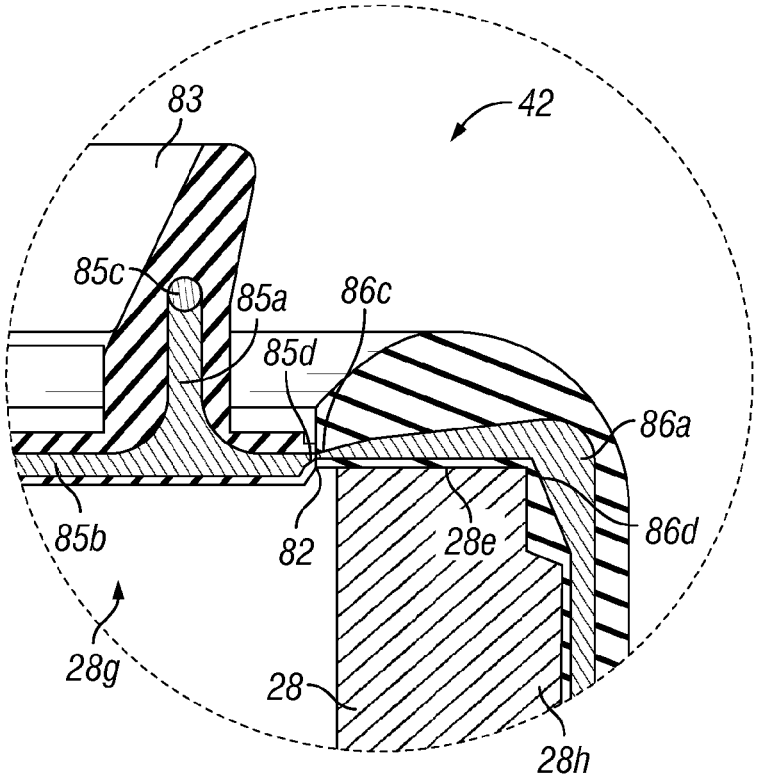

FIG. 15A is an enlarged view of area 15A of FIG. 15.

Figure 15B:
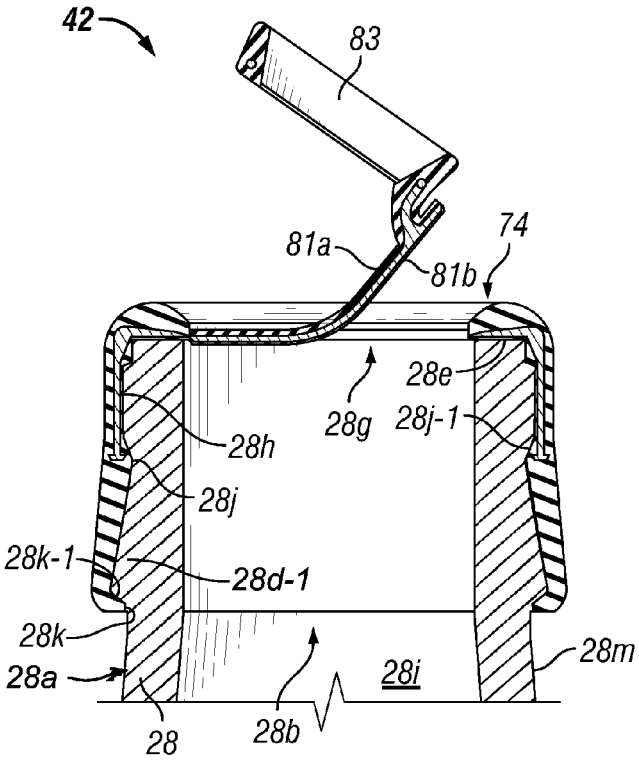

FIG. 15B is same view of FIG. 15, but showing the removable pull tab top enclosure partially opened.

Figure 15C:
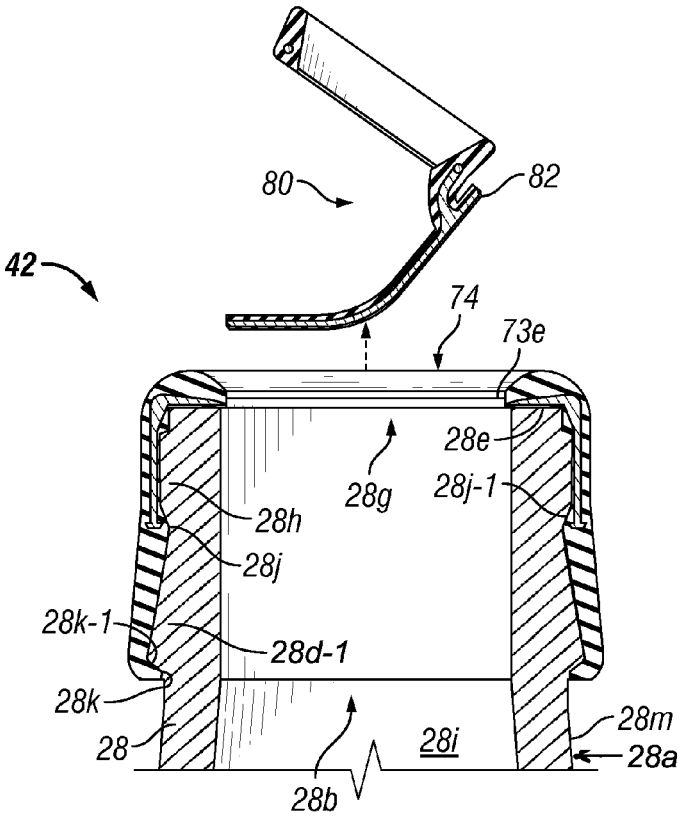

FIG. 15C is same view of FIG. 15, but showing the removable pull tab top enclosure fully opened/removed.

Figure 16:
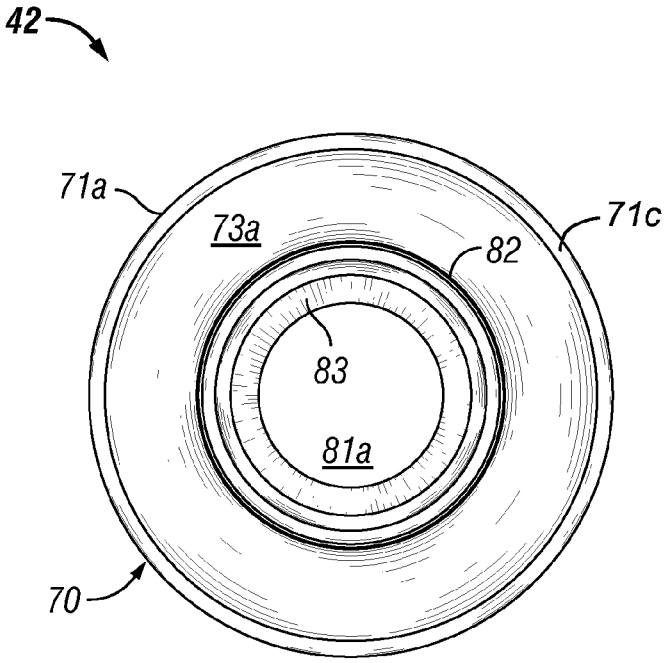

FIG. 16 is a top view of the device shown in FIG. 15.

Figure 17:
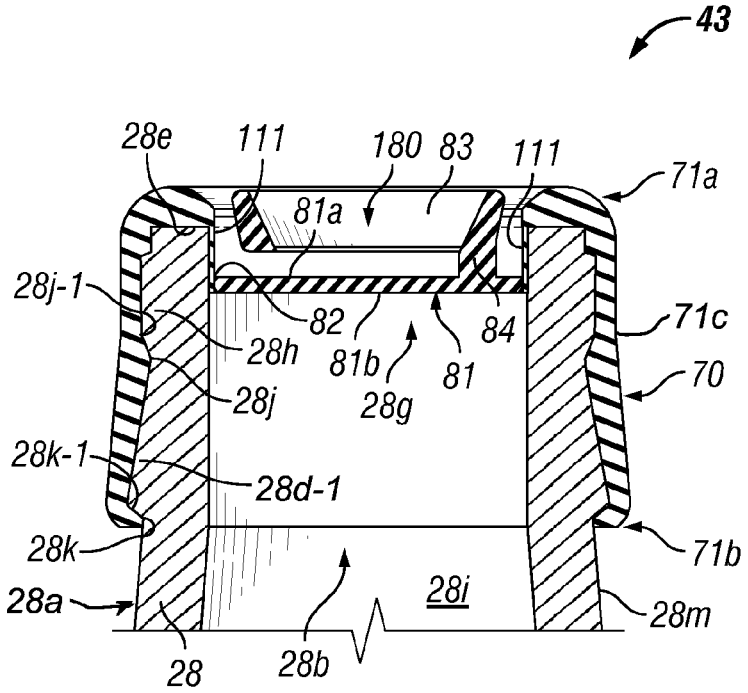

FIG. 17 shows an alternative embodiment of the device of FIG. 12A where the pull tab structure is mounted in a recessed position relative to the top of the device.

Figure 18A:
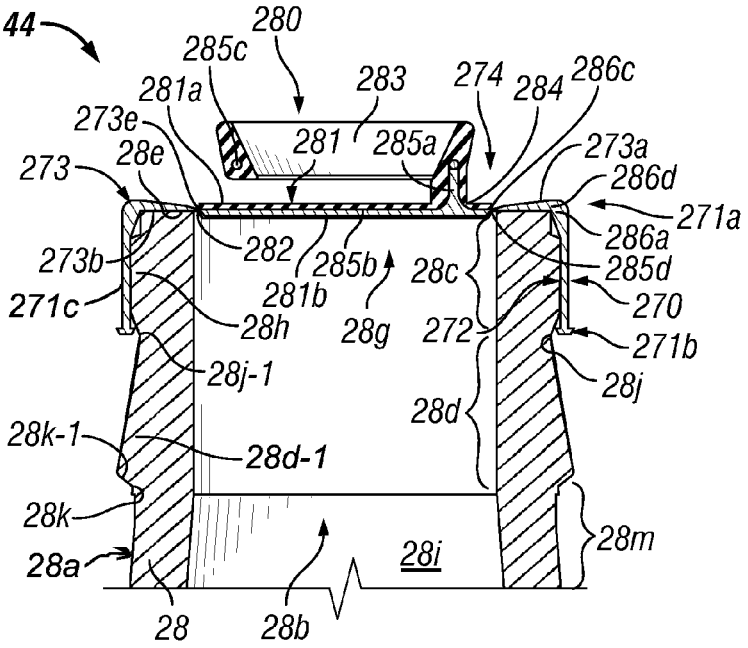

FIG. 18A illustrates a pull top bottle enclosure according to another embodiment of the present disclosure.

Figure 18B:
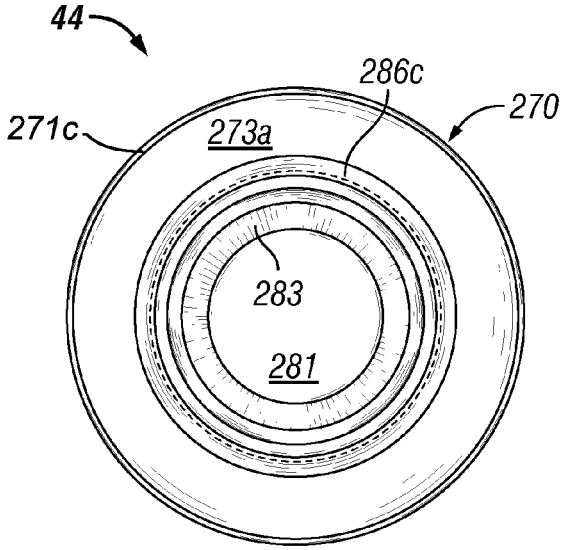

FIG. 18B is a top view of FIG. 18A.

Figure 18C:
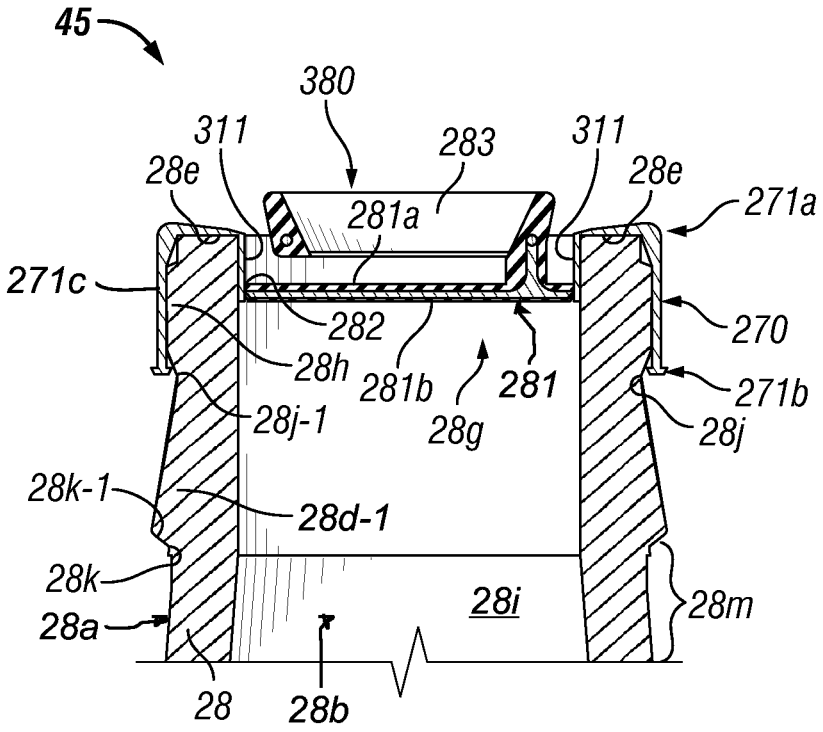

FIG. 18C shows an alternative structure of FIG. 18A where the pull tab is mounted in a recessed or partially recessed position relative to the top of the device.

Figure 19A:
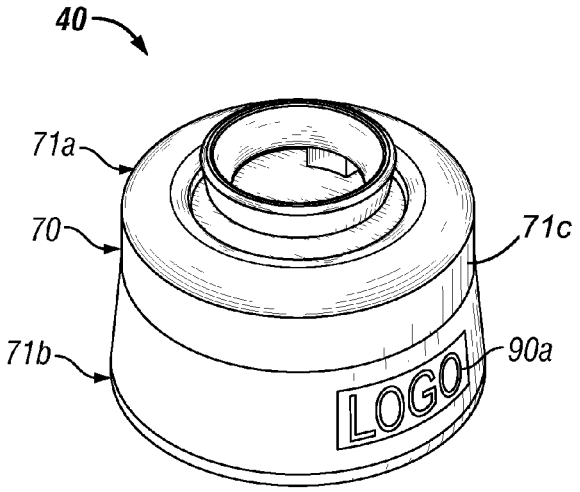

FIG. 19A illustrates the embodiment of, e.g., FIG. 12 employing advertising or branding information (e.g., a logo) on the surface of the device.

Figure 19B:
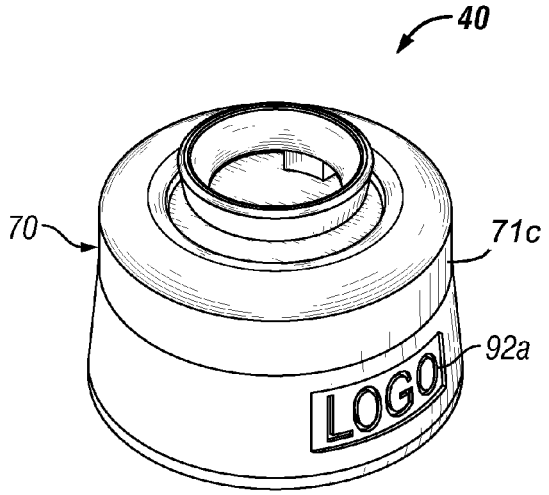

FIG. 19B illustrates the embodiment of, e.g., FIG. 12 employing advertising or branding information (e.g., a logo) on the surface of the device and/or on a recessed surface of the device.

Figure 19C:
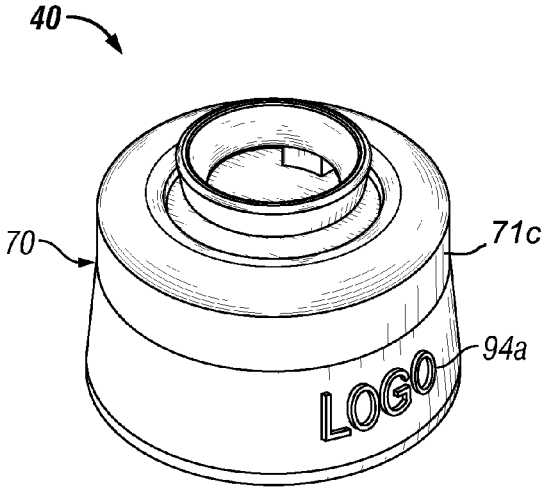

FIG. 19C illustrates the embodiment of, e.g., FIG. 12 employing advertising or branding information (e.g., a logo) on the surface of the device and/or on a raised surface of the device.

Figure 20A:
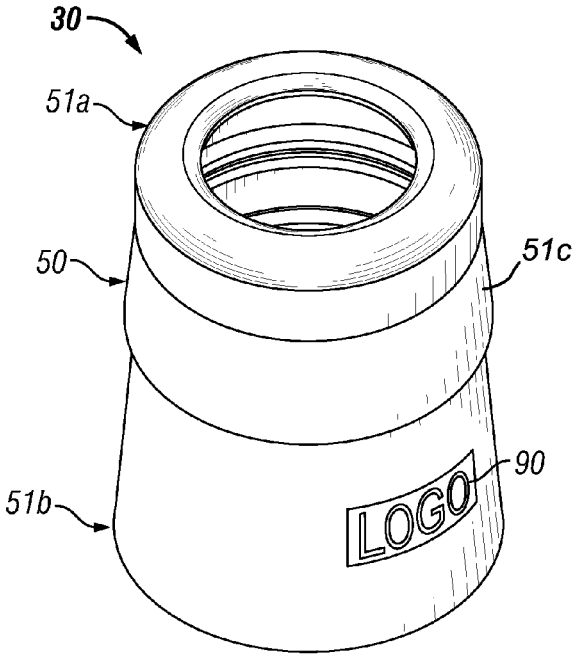

FIG. 20A illustrates the embodiment of, e.g., FIG. 4 employing advertising or branding information (e.g., a logo) on the surface of the device.

Figure 20B:
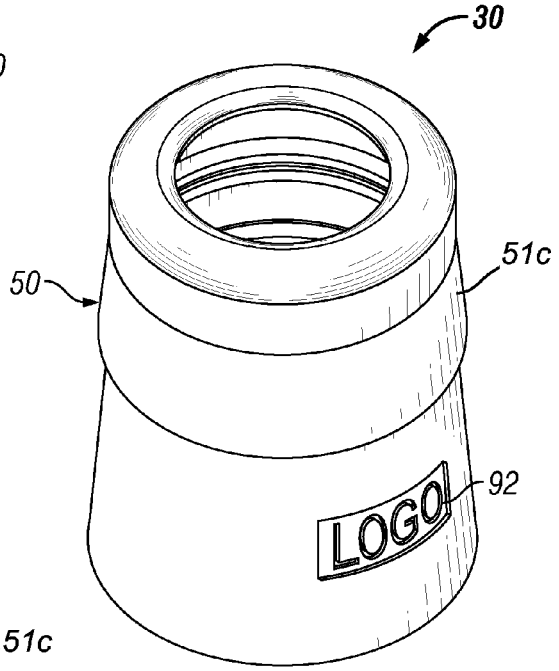

FIG. 20B illustrates the embodiment of, e.g., FIG. 4 employing advertising or branding information (e.g., a logo) on the surface of the device and/or on a recessed surface of the device.

Figure 20C:
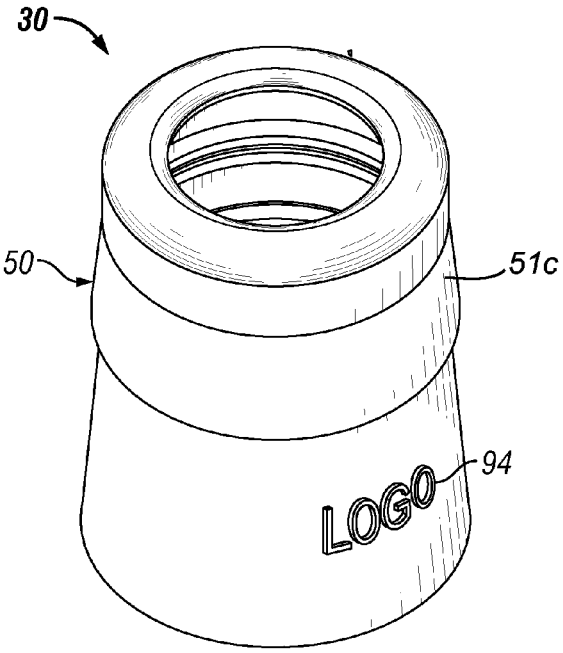

FIG. 20C illustrates the embodiment of, e.g., FIG. 4 employing advertising or branding information (e.g., a logo) on the surface of the device and/or on a raised surface of the device.

DESCRIPTION OF THE SPECIFIC EMBODIMENTS

It will be appreciated that the present invention may take many forms and embodiments. In the following description, some embodiments of the invention are described and numerous details are set forth to provide an understanding of the present invention. Those skilled in the art will appreciate, however, that the present invention may be practiced without those details and that numerous variations and modifications from the described embodiments may be possible. The following description is thus intended to illustrate and not to limit the present invention.

Referring to FIGS. 1 and 2 from applicant's commonly owned, co-pending U.S. application Ser. No. 12/362,487 filed Jan. 29, 2009, issuing as U.S. Pat. No. 8,177,085 on May 15, 2012, a tooth protector 10 in accordance with the present invention is a monolithic structure for insertion into the mouth of a glass bottle and comprises an inner portion 11, an outer portion 12 and a top portion 13. Inner portion 11 and the outer portion 12 are substantially concentric structures and define an annulus 14.

As illustrated in FIGS. 1 and 2, tooth protector 10 may be attached to the glass bottle 15 by inserting the inner portion 11 into the mouth of the glass bottle 15. The annulus 14 receives the neck of the bottle 15. The bottle 15 has a top edge 15*a* defining a mouth opening into the interior space 15*b* of bottle 15 and a top section 15*c* extending downwardly from the top edge 15*a*. The top portion 13 of tooth protector 10 has an outer surface 13*a* and an inner surface 13*b* and a height 13*c* defined as the distance between the outer surface 13*a* and the inner surface 13*b*. The height 13*c* is substantially uniform along the top portion 13. The top portion 13 of tooth protector 10 joins the inner portion 11 and the outer portion 12, and the outer portion 12 and top portion 13 respectively protect the consumer's teeth from the top part of the neck and top edge of glass bottle 15 when the tooth protector is inserted in the mouth of the bottle. The concentric outer portion 12 defines an overall width or outer annular diameter 18 across the top portion 13 of the protector 10. The outer surface 13*a* forms a horizontal plane 20 across the width 18 of the protector. The concentric inner portion 11 and outer portion 12 extend downwardly below the horizontal plane 20. The protector 10 does not comprise structure extending above the horizontal plane 20. The length of outer portion 12 is selected such that the consumer's mouth and teeth are protected from the bottle.

Inner portion 11 of tooth protector 10 comprises an inner face 11*a* and an outer face 11*b*. The inner face 11*a* comprises a bulge 11*c* which functions as a seal to prevent the tooth protector 10 from leaking when the liquid contents of bottle 15 are being consumed. The outer face 11*b* is tapered outwardly as shown to squeeze the inner portion 11 tightly against bottle 15 to prevent leaking. The ends 11*d* of inner portion 11 of tooth protector 10 may be rounded for smooth and easy insertion of the tooth protector 10 into bottle 15.

A tooth protector in accordance with the present invention may be fabricated from a rubber material or a soft plastic material. In one embodiment, a tooth protector in accordance with the present invention may also comprise a clip 16 for attachment of the tooth protector to a keychain or similar structure.

New Disclosure

As will be appreciated, bottle neck regions have outer surface topographies or profiles that vary from bottle style to bottle style. Precise bottle neck finish features (e.g., flange, bead, and thread profiles) vary between bottle styles, and it will be understood by those of ordinary skill in the art having the benefit of the present disclosure, that the internal surface profiles of the tooth protectors and tooth protector bottle enclosures described herein can be adapted to fit any bottle neck style. As such, in connection with the detailed disclosure of the present invention, it will be instructive to highlight the structural features of a few exemplary bottle styles having differing bottle neck structures.

For example, referring to FIGS. 4A-2, 9A and 9B, there is shown a sectional view of the bottle neck region 24*a* located at the top of an exemplary typical generic bottle 24 (made of glass, metal, or other hard material that could adversely impact a tooth). The bottle 24 additionally comprises a mouth 24*g* opening into the interior space 24*i* of the bottle 24. The bottle also has a bottle neck finish area

24*b*—the general area of the bottle that holds the cap or closure (not shown). Additionally, the bottle neck finish area 24*b* typically comprises a top section or bottle head section 24*c* or attachment zone for physically attaching the cap or enclosure (not shown) and a lower portion or circumferential bead section 24*d* (some caps or enclosures may rest on the bead 24*d*-1). The bottle head section 24*c* features a bottle top outer lip 24*e* and raised flange 24*h*. On the neck below the flange 24*h* is shown a circumferential bottle neck bead 24*d*-1 having an elongated profile. A first circumferential bottle indentation or groove 24*j* is formed between the upper part of the bead region 24*d* and the lower part of the flange 24*h*. The first circumferential bottle indentation or groove 24*j* also forms a first circumferential bottle indentation underside shoulder 24*j*-1. A second circumferential bottle indentation or groove 24*k* is formed below the lower part of the bead 24*d*-1 at the interface of the lower part of bead 24*d*-1 and the upper part of the bottle neck upper region 24*m*. The second circumferential bottle indentation or groove 24*k* also forms a second circumferential bottle indentation underside shoulder 24*k*-1.

Referring to FIGS. 10A and 10B, there is shown the bottle neck region 26*a* located at the top of an exemplary typical generic bottle 26 (made of glass, metal, or other hard material that could adversely impact a tooth) having a threaded top. The bottle 26 additionally comprises a mouth 26*g* opening into the interior space of the bottle 26. The bottle also has a bottle neck finish area 26*b*—the general area of the bottle that holds the cap or closure (not shown). Additionally, the bottle neck finish area 26*b* typically comprises a top section or bottle head section 26*c* or attachment zone for physically attaching the cap or enclosure (not shown) and a lower portion or circumferential bead section 26*d* (some caps or enclosures may rest on the bead 26*d*-1). The bottle head section 26*c* features a bottle top outer lip 26*e* and raised threaded section 26*h* for engaging the threads on the inside of a threaded cap or enclosure (not shown) and outer shoulder or lip 26*f*. On the neck below the raised threads 26*h* is shown a circumferential bottle neck bead 26*d*-1. A circumferential bead underside shoulder 26*k*-1 is formed on the underside of the bead 26*d*-1.

Referring now to FIGS. 11B, 12A-1, 12A-2, 15, 15A, 15A, 15C, 17, 18A and 18C, there is shown a sectional view of the bottle neck region 28*a* located at the top of an exemplary specific-brand bottle, such as here, for example, a BUD LIGHT® brand beer bottle 28 (made of glass, metal, or other hard material that could adversely impact a tooth). Similar to the generic bottle 24 described above in connection with FIGS. 4A-2, 9A and 9B, the bottle 28 additionally comprises a mouth 28*g* opening into the interior space 28*i* of the bottle 28. The bottle also has a bottle neck finish area 28*b*—the general area of the bottle that holds the cap or closure (not shown). Additionally, the bottle neck finish area 28*b* typically comprises a top section or bottle head section 28*c* or attachment zone for physically attaching the cap or enclosure (not shown) and a lower portion or circumferential bead section 28*d* (some caps or enclosures may rest on the bead 28*d*-1). The bottle head section 28*c* features a bottle top outer lip 28*e* and raised flange 28*h*. On the neck below the flange 28*h* is shown a circumferential bottle neck bead 28*d*-1 having an elongated profile. A first circumferential bottle indentation or groove 28*j* is formed between the upper part of the bead region 28*d*-1 and the lower part of the flange 28*h*. The first circumferential bottle indentation or groove 28*j* also forms a first circumferential bottle indentation underside shoulder 28*j*-1. A second circumferential bottle indentation or groove 28*k* is formed below the lower part of the bead 28*d*-1 at the interface of the lower part of bead 28*d*-1 and the upper part of the bottle neck upper region 28*m*. The second circumferential bottle indentation or groove 28*k* also forms a second circumferential bottle indentation underside shoulder 28*k*-1.

Referring now to FIGS. 7 and 8, the exemplary tooth protector bottle sleeves 34 and 35 have interior profiles configured to mate with the exterior profiles of specific-brand bottles, such as here, for example, a BUD LIGHT® brand beer bottle described above (not shown) (FIG. 7) and a COORS LIGHT® brand beer bottle (not shown) (FIG. 8). With both of these exemplary bottles (not shown), there exists a bottle head region resembling a circumferential, square-shouldered outward-protruding flange. With the BUD LIGHT® brand beer bottle (not shown) (FIG. 7) there is a first circumferential indentation or groove under the flange at the top of the bottle neck bead section, with the bottle neck bead extending downwardly and sloping outwardly a short distance from the first groove until reaching a second circumferential indentation or groove. Both indentations form underside shoulders. With the COORS LIGHT® brand beer bottle (not shown) (FIG. 8) there is also a first circumferential indentation or groove under the flange at the top of the bottle neck bead section, with the bottle neck bead extending outwardly immediately below the first groove and then extending inwardly to form a second circumferential indentation resulting in flange-like or collar-like bead profile. Both indentations form underside shoulders.

Referring now to FIG. 3B, a hypothetical bottle 22 is shown that essentially blends together the bottle exterior profiles of the BUD LIGHT® brand beer bottle (FIGS. 7, 11B, 12A-1, 12A-2, 15, 15A, 15B, 15C, 17, 18A and 18C) and a COORS LIGHT® brand beer bottle (FIG. 8) discussed above such that there exists a bottle head region 22*c* resembling a circumferential, square-shouldered outward-protruding flange 22*h*, and a double bead bottle neck bead region 22*d*. Although the profile of bottle 22 is hypothetical, it serves as a template for designing an interior profile of a tooth protector bottle sleeve 30 (FIGS. 3A, 3B, 4, 4A, 4A-1, 4A-2, 5, 6 and 20A-20C) that can serve as a universal fit tooth protector sleeve that can fit on multiple bottle styles, such as, for example, a BUD LIGHT® brand beer bottle (FIG. 7), a COORS LIGHT® brand beer bottle (FIG. 8), a generic bottle 24 (FIG. 4A-2) and a generic threaded top bottle 26 (much like in FIG. 10A).

The above discussion of various bottle exterior profile designs is exemplary, and not meant to limit the types of bottles that could be suitable for use with the tooth protectors (e.g., 30, 31, 32, 33, 34, 35, 36, 37, 38, 39) and combination bottle top enclosures and tooth protectors (40, 41, 42, 43) of the present disclosure. With this sampling of bottle neck profiles in mind, the following presents exemplary tooth protectors and combination bottle top enclosures and tooth protectors.

Referring now to FIGS. 3A, 3B, 4, 4A, 4A-1, 4A-2, 5, 6 and 20A-20C, there is shown various views of another exemplary embodiment of a tooth protector bottle sleeve 30 according to the present disclosure. As noted above, typically, a bottle 22 (here a hypothetical bottle) will have a bottle neck region 22*a* at its top, opening into the mouth 22*g* of the bottle 22. The bottle 22 will have an interior space 22*i*. The bottle 22 has a top edge 22*e* defining a mouth opening 22*g* into the interior space 22*i* of bottle 22. The upper portion of the bottle neck region 22*a* typically comprises the bottle neck finish area 22*b*, the general area of the bottle that holds the cap or closure (not shown). The bottle neck finish area

22*b* typically comprises a top section or bottle head section 22*c* or attachment zone for physically attaching the cap or enclosure (not shown) and a lower portion or circumferential bead section 22*d* (some caps or enclosures may rest on the bead section 22*d*). As shown in FIG. 3B, for example, the bottle head section 22*c* comprises a circumferential flange 22*h* extending outward for receiving a crown style cap (not shown) that is crimped over the flange to secure the cap in sealed relation to the flange to create a seal over the mouth 22*g*. Below the bottle head section 22*c* is the bottle neck bead section 22*d*. The top-most surface of the bottle is the bottle top edge 22*e*. The top part of the bottle head region 22*c* comprises a shoulder/lip 22*f* as part of the flange 22*h* where a seal with bottle top edge 22*e* is formed with the bottle top cap or enclosure (not shown).

In this embodiment, tooth protector 30 is a monolithic open-ended concentric sleeve structure for insertion over the top of an open bottle 22 and comprises a generally vertically-oriented outer sleeve member 50, having an outer surface upper portion 50*a* (generally corresponding to the vertically-oriented bottle neck finish area 22*b*) and a generally vertically-oriented outer surface lower portion or skirt 50*b* (generally corresponding to the vertically-oriented bottle neck upper region 22*m*). Protector 30 also has a sleeve top end 51*a* and a sleeve bottom end 51*b*. The tooth protector bottle sleeve 30 also comprises an inner surface 52 for engaging the outer surface of the bottle 22 and an outer surface 51*c*. Tooth protector 30 further comprises a concentric horizontally-oriented protector upper lip 53 located at the top end 51*a* of the protector outer surface upper end and extending inwardly to a width sufficient to cover (or substantially cover) the width of the bottle upper lip 22*e* and to create a sleeve upper opening 54 that is approximately or substantially the same opening size as the opening of the bottle mouth 22*g*. A sleeve lower opening 56 is formed along the sleeve bottom end 51*b*. More particularly, upper lip 53 comprises: an upper lip top side 53*a* for protecting a person's teeth from contacting the bottle upper lip 22*e*, an upper lip underside 53*b* for creating a seal with bottle upper lip 22*e*, an upper lip edge height 53*c* defined as the distance between the upper lip top side 53*a* and the upper lip underside 53*b*, an optional upper lip rounded or tapered surface 53*d*, and an upper lip interior edge 53*e* defining the sleeve upper opening 54. The height 53*c* is substantially uniform along the upper lip top side 53*a*. The outer portion 50 and top portion or lip 53 respectively protect the consumer's teeth from the top part of the neck and top edge of the bottle 22 when the tooth protector is inserted over the top of the bottle.

The concentric outer portion 50 defines an overall width or outer annular diameter 58 across the top portion 53 of the protector 30. The upper lip top side 53*a* forms a horizontal plane 20 across the width 58 of the protector 30. The concentric outer portion 50 extends downwardly below the horizontal plane 20. The protector 30 does not comprise structure extending above the horizontal plane 20. The overall length of outer portion 50 is selected such that the consumer's mouth and teeth are protected from the bottle 22.

The protector sleeve's inner surface 52 is designed to sufficiently engage the outer surface of the bottle 22 to maintain the sleeve 30 in place on the bottle when in use, and to create a seal between the sleeve lip underside 53*b* and the top lip 22*e* of the bottle 22. For example, in this embodiment, the sleeve inner surface 52 has surface profile features that mate with the surface profile features of the bottle 22. For example, sleeve inner surface 52 contains an internal upper shoulder 52*a* for mating with the bottle shoulder 22*f* to assist in creating a sealed relationship. Also, sleeve inner surface 52 contains first concentric groove 52*b* for receiving the bottle flange 22*h*. Below first groove 52*b* is a first concentric protrusion 52*c* that mates with the bottle first circumferential indentation 22*j* and is locked into place against first indentation shoulder 22*j*-1. Beneath first concentric protrusion 52*c* is a second concentric groove 52*d* for receiving bottle first bead 22*d*-1. Beneath second concentric groove 52*d* is a second concentric protrusion 52*e* that mates with the bottle second circumferential indentation or groove 22*k* and is locked into place against second indentation shoulder 22*k*-1. Beneath second concentric protrusion 52*e* is a third concentric groove 52*f* for receiving bottle second bead 22*d*-2. Beneath third concentric groove 52*f* is a third concentric protrusion 52*g* that mates with the bottle third circumferential indentation or groove 22*l* and is locked into place against third indentation shoulder 22*l*-1. Beneath third concentric protrusion 52*g* is the sleeve inner skirt section 52*h* that may nest against the bottle neck upper region 22*m*. Thus, in this exemplary embodiment, the tooth protector sleeve 30 is held snugly against the outer surface of the bottle 22 by one or more concentric beads/flanges/protrusions nested in one or more respective concentric grooves/recesses.

As noted above, the tooth protector sleeve 30 embodiment of the present disclosure is designed to provide a universal internal surface 52*h* profile that can accommodate varying bottle outer profiles. For example, FIG. 4A-2 illustrates a generic bottle 24 outfitted with tooth protector sleeve 30. In this embodiment, the protector sleeve's inner surface 52 is designed to sufficiently engage the outer surface of the bottle 24 to maintain the sleeve 30 in place on the bottle when in use, and to create a seal between the sleeve lip underside 53*b* and the top lip 24*e* of the bottle 24. For example, in this embodiment, the sleeve inner surface 52 has surface profile features that substantially mate with the surface profile features of the bottle 24. For example, sleeve inner surface 52 contains an internal upper shoulder 52*a* for mating against the outside of bottle flange 24*h* to assist in creating a sealed relationship. Also, sleeve inner surface 52 contains first concentric groove 52*b* for receiving the bottle flange 22*h*. Below first groove 52*b* is a first concentric protrusion 52*c* that creates a mated locking relationship between the bottle first circumferential indentation 24*j* and is locked into place against first indentation shoulder 24*j*-1. In this embodiment, the bottle bead 24*d*-1 is received into third concentric groove 52*f*. Beneath third concentric groove 52*f* is a third concentric protrusion 52*g* that mates with the bottle second circumferential indentation or groove 24*k* and is locked into place against second indentation shoulder 24*k*-1. Thus, in this exemplary embodiment, the tooth protector sleeve 30 is held snugly against the outer surface of the bottle 24 by one or more concentric beads/flanges/protrusions nested in one or more respective concentric grooves/recesses.

FIGS. 4A-3, 4A-4, and 4A-5 show variations of the basic bottle protector sleeve 30 described above. In particular, FIG. 4A-3 shows another embodiment of the present invention wherein the tooth protector bottle sleeve 31 has been modified to represent a two-layer structure: the inner layer 60 that mates with or that otherwise receives the bottle 22 has more structural support (e.g., a harder plastic material by way of example and without limitation) while the outer layer 62 that covers the top and top portions of the sides of the sleeve 31 is a softer material (such as the material used for protector 30) to provide cushioning for the teeth. In this embodiment, the cushioning layer 62 extends down the sides of the bottle 22 to cover the general area of the bottle neck finish area 22*b*. Similarly, FIG. 4A-4 shows another tooth protector sleeve 32 embodiment of the present invention much like in FIG. 4A-3 but wherein the exterior soft layer 62*a* of the tooth protector sleeve extends down the full length of the inner structural layer 60. Similarly, FIG. 4A-5 is another embodiment of the present tooth protector sleeve 33 invention much like in FIG. 4A-3 but wherein the interior structural layer 60*a* of the tooth protector sleeve 33 mates with the top section of the bottle (the bottle neck finish area 22*b*), and the exterior soft layer 62*b* extends further downward than the interior layer.

FIG. 7 is a longitudinal cross sectional view of another embodiment of the present invention similar to that of FIG. 4A except that the interior contours of the tooth protector bottle sleeve are different, i.e., customized for a particular bottle profile, such as here, for example, a BUD LIGHT® brand beer bottle (Anheuser-Busch Incorporated). In this embodiment, tooth protector 34 is a monolithic open-ended concentric sleeve structure for insertion over the top of an open bottle 28 (not shown in this figure) and comprises a generally vertically-oriented outer sleeve member 150, having an outer surface upper portion 150*a* (generally corresponding to the vertically-oriented bottle neck finish area 28*b*) and a generally vertically-oriented outer surface lower portion or skirt 150*b* (generally corresponding to the vertically-oriented bottle neck upper region 28*m*). Protector 34 also has a sleeve top end 151*a* and a sleeve bottom end 151*b*. The tooth protector bottle sleeve 34 also comprises an inner surface 152 for engaging the outer surface of the bottle 28 and an outer surface 151*c*. Tooth protector 34 further comprises a concentric horizontally-oriented protector upper lip 153 located at the top end 151*a* of the protector outer surface upper end and extending inwardly to a width sufficient to cover (or substantially cover) the width of the bottle upper lip 28*e* and to create a sleeve upper opening 154 that is approximately or substantially the same opening size as the opening of the bottle mouth 28*g*. More particularly, upper lip 153 comprises: an upper lip top side 153*a* for protecting a person's teeth from contacting the bottle upper lip 28*e*, an upper lip underside 153*b* for creating a seal with bottle upper lip 28*e*, an upper lip edge height 153*c* defined as the distance between the upper lip top side 153*a* and the upper lip underside 153*b*, an optional upper lip rounded or tapered surface 153*d*, and an upper lip interior edge 153*e* defining the sleeve upper opening 154. The height 153*c* is substantially uniform along the top portion 153. The outer portion 150 and top portion or lip 153 respectively protect the consumer's teeth from the top part of the neck and top edge of the bottle 28 when the tooth protector is inserted over the top of the bottle.

The concentric outer portion 150 defines an overall width or outer annular diameter (not shown, but like 58 in FIG. 4) across the top portion 153 of the protector 34. The upper lip top side 153*a* forms a horizontal plane (like 20 in FIG. 4A-1) across the width of the protector 34. The concentric outer portion 150 extends downwardly below the horizontal plane 20. The protector 34 does not comprise structure extending above the horizontal plane 20. The overall length of outer portion 150 is selected such that the consumer's mouth and teeth are protected from the bottle 28.

The protector 34 sleeve's inner surface 152 is designed to sufficiently engage the outer surface of the bottle 28 to maintain the sleeve 34 in place on the bottle when in use, and to create a seal between the sleeve lip underside 153*b* and the top lip 28*e* of the bottle 28. For example, in this embodiment, the sleeve inner surface 152 has surface profile features that mate with the surface profile features of the bottle 28. For example, sleeve inner surface 152 contains an internal upper shoulder 152*a* for mating with the bottle shoulder 28*f* to assist in creating a sealed relationship. Also, sleeve inner surface 152 contains first concentric groove 152*b* for receiving the bottle flange 28*h*. Below first groove 152*b* is a first concentric protrusion 152*c* that mates with the bottle first circumferential indentation 28*j* and is locked into place against first indentation shoulder 28*j*-1. In this embodiment, the bottle bead 28*d*-1 is received into a second concentric groove 152*f*. Beneath first concentric protrusion 152*c* is a second concentric groove 152*f* for receiving bottle bead 28*d*-1. Beneath second concentric groove 152*f* is a second concentric protrusion 152*g* that mates with the bottle second circumferential indentation or groove 28*k* and is locked into place against second indentation shoulder 28*k*-1. Beneath second concentric protrusion 152*g* is the sleeve inner skirt section 152*h* that may nest against the bottle neck upper region 28*m*. Thus, in this exemplary embodiment, the tooth protector sleeve 34 is held snugly against the outer surface of the bottle 28 by one or more concentric beads/flanges/protrusions nested in one or more respective concentric grooves/recesses.

FIG. 8 is a longitudinal cross sectional view of another embodiment of the present invention similar to that of FIG. 4A and FIG. 7 except that the interior contours of the tooth protector bottle sleeve are different, i.e., customized for a particular bottle profile, such as here, for example, a COORS LIGHT® brand beer bottle (MillerCoors LLC). In this embodiment, tooth protector 35 is a monolithic open-ended concentric sleeve structure for insertion over the top of an open bottle (not shown) and comprises a generally vertically-oriented outer sleeve member 250, having an outer surface upper portion 250*a* (generally corresponding to the vertically-oriented bottle neck finish area, not shown) and a generally vertically-oriented outer surface lower portion or skirt 250*b* (generally corresponding to the vertically-oriented bottle neck upper region, not shown). Protector 35 also has a sleeve top end 251*a* and a sleeve bottom end 251*b*. The tooth protector bottle sleeve 35 also comprises an inner surface 252 for engaging the outer surface of the bottle and an outer surface 251*c*. Tooth protector 35 further comprises a concentric horizontally-oriented protector upper lip 253 located at the top end 251*a* of the protector outer surface upper end and extending inwardly to a width sufficient to cover (or substantially cover) the width of the bottle upper lip (not shown) and to create a sleeve upper opening 254 that is approximately or substantially the same opening size as the opening of the bottle mouth (not shown). More particularly, upper lip 253 comprises: an upper lip top side 253*a* for protecting a person's teeth from contacting the bottle upper lip, an upper lip underside 253*b* for creating a seal with bottle upper lip, an upper lip edge height defined as the distance between the upper lip top side 253*a* and the upper lip underside 253*b*, an optional upper lip rounded or tapered surface 253*d*, and an upper lip interior edge 253*e* defining the sleeve upper opening 254. The height is substantially uniform along the top portion 253. The outer portion 250 and top portion or lip 253 respectively protect the consumer's teeth from the top part of the neck and top edge of the bottle when the tooth protector is inserted over the top of the bottle.

The concentric outer portion 250 defines an overall width or outer annular diameter (not shown, but like 58 in FIG. 4) across the top portion 253 of the protector 35. The upper lip top side 253*a* forms a horizontal plane 20 across the width of the protector 35. The concentric outer portion 250 extends downwardly below the horizontal plane 20. The protector 35 does not comprise structure extending above the horizontal plane 20. The overall length of outer portion 250 is selected such that the consumer's mouth and teeth are protected from the bottle.

The protector 35 sleeve's inner surface 252 is designed to sufficiently engage the outer surface of the bottle to maintain the sleeve 35 in place on the bottle when in use, and to create a seal between the sleeve lip underside 253*b* and the top lip of the bottle. For example, in this embodiment, the sleeve inner surface 252 has surface profile features that mate with the surface profile features of the bottle (not shown). For example, sleeve inner surface 252 contains an internal upper shoulder 252*a* for mating with the bottle shoulder (not shown) to assist in creating a sealed relationship. Also, sleeve inner surface 252 contains first concentric groove 252*b* for receiving the bottle flange (not shown). Below first groove 252*b* is a first concentric protrusion 252*c* that mates with the bottle first circumferential indentation (not shown) and is locked into place against first indentation shoulder (not shown). In this embodiment, the bottle bead (not shown) is received into a second concentric groove 252*f*. Beneath first concentric protrusion 252*c* is a second concentric groove 252*f* for receiving the bottle bead. Beneath second concentric groove 252*f* is a second concentric protrusion 252*g* that mates with the bottle second circumferential indentation or groove (not shown) and is locked into place against second indentation shoulder (not shown). Beneath second concentric protrusion 252*g* is the sleeve inner skirt section 252*h* that may nest against the bottle neck upper region (not shown). Thus, in this exemplary embodiment, the tooth protector sleeve 35 is held snugly against the outer surface of the bottle (not shown) by one or more concentric beads/flanges/protrusions nested in one or more respective concentric grooves/recesses.

FIG. 9A is a longitudinal cross sectional view of another embodiment of a tooth protector bottle sleeve 36 of the present invention similar to that of FIG. 4A except that the interior contours of the tooth protector bottle sleeve generally follow the contours of a standard beverage bottle neck, such as bottle 24 described above. The interface between the sleeve 36 and bottle 24 is similar to that with respect to sleeves 34 and 35 (FIGS. 7-8). Specifically, in this embodiment, tooth protector 36 is a monolithic open-ended concentric sleeve structure for insertion over the top of an open bottle 24 and comprises a generally vertically-oriented outer sleeve member 350, having an outer surface upper portion 350*a* (generally corresponding to the vertically-oriented bottle neck finish area 24*b*) and a generally vertically-oriented outer surface lower portion or skirt 350*b* (generally corresponding to the vertically-oriented bottle neck upper region 24*m*). Protector 36 also has a sleeve top end 351*a* and a sleeve bottom end 351*b*. The tooth protector bottle sleeve 36 also comprises an inner surface 352 for engaging the outer surface of the bottle 24 and an outer surface 351*c*. Tooth protector 36 further comprises a concentric horizontally-oriented protector upper lip 353 located at the top end 351*a* of the protector outer surface upper end and extending inwardly to a width sufficient to cover (or substantially cover) the width of the bottle upper lip 24*e* and to create a sleeve upper opening 354 that is approximately or substantially the same opening size as the opening of the bottle mouth 24*g*. More particularly, upper lip 353 comprises: an upper lip top side 353*a* for protecting a person's teeth from contacting the bottle upper lip 24*e*, an upper lip underside 353*b* for creating a seal with bottle upper lip 26*e*, an upper lip edge height defined as the distance between the upper lip top side 353*a* and the upper lip underside 353*b*, an optional upper lip rounded or tapered surface 353*d*, and an upper lip interior edge 353*e* defining the sleeve upper opening 354. The height is substantially uniform along the top portion 353. The outer portion 350 and top portion or lip 353 respectively protect the consumer's teeth from the top part of the neck and top edge of the bottle 24 when the tooth protector is inserted over the top of the bottle.

The concentric outer portion 350 defines an overall width or outer annular diameter (not shown, but like 58 in FIG. 4) across the top portion 353 of the protector 36. The upper lip top side 353*a* forms a horizontal plane 20 across the width of the protector 36. The concentric outer portion 350 extends downwardly below the horizontal plane 20. The protector 36 does not comprise structure extending above the horizontal plane 20. The overall length of outer portion 350 is selected such that the consumer's mouth and teeth are protected from the bottle 24.

The protector 36 sleeve's inner surface 352 is designed to sufficiently engage the outer surface of the bottle 24 to maintain the sleeve 36 in place on the bottle when in use, and to create a seal between the sleeve lip underside 353*b* and the top lip 24*e* of the bottle 24. For example, in this embodiment, the sleeve inner surface 352 has surface profile features that mate with the surface profile features of the bottle 24. For example, sleeve inner surface 352 contains an internal upper shoulder 352*a* for mating with the bottle shoulder 24*f* to assist in creating a sealed relationship. Also, sleeve inner surface 352 contains first concentric groove 352*b* for receiving the bottle flange 24*h*. Below first groove 352*b* is a first concentric protrusion 352*c* that mates with the bottle first circumferential indentation 24*j* and is locked into place against first indentation shoulder 24*j*-1. In this embodiment, the bottle bead 24*d*-1 is received into a second concentric groove 352*f*. Beneath first concentric protrusion 352*c* is a second concentric groove 352*f* for receiving bottle bead 24*d*-1. Beneath second concentric groove 352*f* is a second concentric protrusion 352*g* that mates with the bottle second circumferential indentation or groove 24*k* and is locked into place against second indentation shoulder 24*k*-1. Beneath second concentric protrusion 352*g* is the sleeve inner skirt section 352*h* that may nest against the bottle neck upper region 24*m*. Thus, in this exemplary embodiment, the tooth protector sleeve 36 is held snugly against the outer surface of the bottle 24 by one or more concentric beads/flanges/protrusions nested in one or more respective concentric grooves/recesses.

FIG. 9B is a longitudinal cross sectional view of another embodiment of the present bottle sleeve 37 invention similar to that of FIG. 9A except that the exterior (generally vertically-oriented outer surface lower portion or skirt 350*b*, generally corresponding to the vertically-oriented bottle neck upper region 24*m*) is shortened. In this embodiment, the sleeve 37 stays in place by the interaction of the sleeve 37 interior surface 352 with just the bottle profile upper end 24*c*, engaging just the bottle head/flange area 24*c* in the sleeve first protrusion 352*b* without the need to engage over the bottle bead 24*d*-1. In this embodiment, sleeve upper portion 350*a* essentially snaps over the bottle flange 24*h* (i.e., first concentric protrusion 352*c* snaps over bottle head flange 24*h* into first circumferential bottle indentation or groove 24*j* and is locked in place by shoulder 24*j*-1. The sleeve outer surface 350*a* provides the cushioning to protect the consumer's teeth.

Referring also to FIGS. 10A and 10B, the bottle head/flange region 26*c* of bottle 26 comprises a threaded flange 26*h* for attaching twist off or threaded style cap (not shown) that may rest on bead 26*d*-1. Specifically, FIG. 10A is a longitudinal cross sectional view of a sleeve embodiment 38 of the present invention similar to that of FIG. 4A except that the interior contours of the tooth protector bottle sleeve are configured to fit over a bottle 26 employing a threaded top (the bottle being shown here in environmental view), or a profile that is similar to the COORS LIGHT® bottle profile discussed above in connection with sleeve embodiment 35 (FIG. 8). In this embodiment, sleeve 38 is adapted to be installed on the top of an opened twist-off cap bottle 26 or other bottle employing traditional threads where here, the primary force holding the sleeve in place is the snap fit interface below the threads. In other words, the protruding threads 26*h* are received into corresponding groove, much like flanges of earlier embodiments are received into grooves, and the bottle bead 26*d*-1 is received into groove to hold the sleeve in place over the neck of the opened bottle 26. More particularly, in this embodiment, tooth protector 38 is a monolithic open-ended concentric sleeve structure for insertion over the top of an open bottle 26 and comprises a generally vertically-oriented outer sleeve member 450, having an outer surface upper portion 450*a* (generally corresponding to the vertically-oriented bottle neck finish area 26*b*) and a generally vertically-oriented outer surface lower portion or skirt 450*b* (generally corresponding to the vertically-oriented bottle neck upper region 26*m*). Protector 38 also has a sleeve top end 451*a* and a sleeve bottom end 451*b*. The tooth protector bottle sleeve 38 also comprises an inner surface 452 for engaging the outer surface of the bottle 26 and an outer surface 451*c*. Tooth protector 38 further comprises a concentric horizontally-oriented protector upper lip 453 located at the top end 451*a* of the protector outer surface upper end and extending inwardly to a width sufficient to cover (or substantially cover) the width of the bottle upper lip 26*e* and to create a sleeve upper opening 454 that is approximately or substantially the same opening size as the opening of the bottle mouth 26*g*. More particularly, upper lip 453 comprises: an upper lip top side 453*a* for protecting a person's teeth from contacting the bottle upper lip 26*e*, an upper lip underside 453*b* for creating a seal with bottle upper lip 26*e*, an upper lip edge height 453*e* defined as the distance between the upper lip top side 453*a* and the upper lip underside 453*b*, an optional upper lip rounded or tapered surface 453*d*, and an upper lip interior edge 453*e* defining the sleeve upper opening 454. The height is substantially uniform along the top portion 453. The outer portion 450 and top portion or lip 453 respectively protect the consumer's teeth from the top part of the neck and top edge of the bottle 26 when the tooth protector is inserted over the top of the bottle.

The concentric outer portion 450 defines an overall width or outer annular diameter knot shown, but like 58 in FIG. 4) across the top portion 453 of the protector 38. The outer surface 453*a* forms a horizontal plane 20 across the width of the protector 38. The concentric outer portion 450 extends downwardly below the horizontal plane 20. The protector 38 does not comprise structure extending above the horizontal plane 20. The overall length of outer portion 450 is selected such that the consumer's mouth and teeth are protected from the bottle 26.

The protector 38 sleeve's inner surface 452 is designed to sufficiently engage the outer surface of the bottle 26 to maintain the sleeve 38 in place on the bottle when in use, and to create a seal between the sleeve lip underside 453*b* and the top lip 26*e* of the bottle 26. For example, in this embodiment, the sleeve inner surface 452 has surface profile features that mate with, or otherwise are received into, the surface profile features of the bottle 26. For example, sleeve inner surface 452 contains an internal upper shoulder 452*a* for mating with the bottle shoulder 26*f* to assist in creating a sealed relationship. Also, sleeve inner surface 452 contains first concentric groove 452*b* for receiving the bottle flange 26*h*. Below first groove 452*b* is a first concentric protrusion 452*c* that mates with the bottle first circumferential indentation 26*j* and is locked into place against first indentation shoulder 26*j*-1. In this embodiment, the bottle bead 26*d*-1 is received into a second concentric groove 452*f*. Beneath first concentric protrusion 452*c* is a second concentric groove 452*f* for receiving bottle bead 26*d*-1. Beneath second concentric groove 452*f* is a second concentric protrusion 452*g* that mates with the bottle second circumferential indentation or groove 26*k* and is locked into place against second indentation shoulder 26*k*-1. Beneath second concentric protrusion 454*g* is the sleeve inner skirt section 452*h* that may nest against the bottle neck upper region 26*m*. Thus, in this exemplary embodiment, the tooth protector sleeve 38 is held snugly against the outer surface of the bottle 26 by one or more concentric beads/flanges/protrusions nested in one or more respective concentric grooves/recesses.

FIG. 10B is a longitudinal cross sectional view of another tooth protector sleeve embodiment 39 of the present invention similar to that of FIG. 10A except that the interior contours of the tooth protector bottle sleeve contain mated threads 452*i* for engaging the threads 26*h* on the bottle 26. Additionally, in this embodiment, the skirt region of the sleeve 39 is shorter than that in sleeve 38 (FIG. 10A). In this embodiment, tightening the sleeve 39 onto bottle threads 26*h* brings sleeve upper lip 453*b* into sealing contact with bottle upper lip 26*e*. Unlike with FIG. 10A, the sleeve 39 of FIG. 10B does not rely on an interference or snap fit of the sleeve 39 over the bottle bead 26*d*-1. In this embodiment, if desired, sleeve outer member 450 could have a skirt 450*b* that extends over the bead 26*d*-1 to conceal the bead 26*d*-1. Although not shown, the embodiments of FIGS. 10A and 10B could be modified to contain internal structure (of a harder material) for creating the interference/snap or threaded fit onto bottle 26 (much like in FIGS. 4A-4, 4A-4, 4A-5) where an outer layer of cushioning material is provided over the internal structural layer.

Referring now to FIGS. 11A, 11B, 12, 12A, 12A-1, 12A-2, 12A-3, 13, 14, 19A, 19B, 19C, there is disclosed an exemplary bottle top enclosure 40 for sealing a beverage bottle containing liquid beverage, where the exterior of the bottle top enclosure 40 comprises a cushioning material to protect the consumer's teeth when consuming the beverage from the bottle after opening. Generally speaking, the bottle top enclosure resembles the protective sleeves, e.g., sleeve 34 (FIG. 7) and sleeve 37 (FIG. 9B) except that they are modified to include a removable seal structure 80 that closes sleeve opening (e.g., 54, 154, 354), and where the bottle top enclosure is permanently attached to the bottle (after filling the bottle) much like other beverage bottles are sealed with a cap during the bottling process. Alternatively, the inside surface of bottle top enclosure 40 could have a threaded connection for threading engagement to a bottle, while still providing the removable seal structure 80 to permit opening the bottle without unscrewing the threaded top. Thus, the bottle top enclosure 40 has an internal profile that mates with the bottle upper end to permit installing on the bottle using all customary installation techniques known in the art, including, e.g., shrink fit, snap on fit, adhering with adhesive, crimping, threaded connections, etc.

The combination bottle top enclosure and tooth protector 40 according to this embodiment generally comprises a structure for insertion over the top of a beverage bottle 28 to be sealed after filling with beverage, and comprises a generally vertically-oriented concentric outer member portion 70. Outer member 70 may comprise an upper region 70*a* generally corresponding to the vertically-oriented bottle neck finish area 28*b*. Outer member 70 may also have a generally vertically-oriented outer surface lower portion or skirt (not shown, generally corresponding to the vertically-oriented bottle neck upper region 28*m*, much like the skirt 150*b* shown in FIG. 7 if added length of cushioning material is desired). Protector enclosure 40 also has a sleeve top end 71*a* and a sleeve bottom end 71*b* and an outer surface 71*c*. The bottle enclosure 40 also comprises an inner surface 72 for engaging the outer surface of the bottle 28 to permit sealing the bottle once the bottle has been filled with beverage. Protector enclosure 40 further comprises a concentric horizontally-oriented protector upper lip 73 located at the top end 71*a* of the protector outer surface upper end (and attached thereto) and extending inwardly to a width sufficient to cover (or substantially cover) the width of the bottle upper lip 28*e* and to create a sleeve upper opening 74 that is approximately or substantially the same opening size as the opening of the bottle mouth 28*g* when the seal 80 is removed (see, e.g., FIG. 15C for an example embodiment illustrating the seal 80 removed). More particularly, upper lip 73 comprises: an upper lip top side 73*a* for protecting a person's teeth from contacting the bottle upper lip 28*e*, an upper lip underside 73*b* for creating a seal with bottle upper lip 28*e*, an upper lip edge height 73*c* defined as the distance between the upper lip top side 73*a* and the upper lip underside 73*b*, an optional upper lip rounded or tapered surface 73*d*, and an upper lip interior edge 73*e* defining the sleeve upper opening 74. The height 73*c* is substantially uniform along the top portion 73. The outer portion 70 and top portion or lip 73 respectively protect the consumer's teeth from the top part of the neck and top edge of the bottle 28 when the tooth protector is installed over the top of the bottle.

The concentric outer portion 70 defines an overall width or outer annular diameter (like 58 in FIG. 4) across the top portion 73 of the enclosure 40. The upper lip top side 73*a* forms a horizontal plane 20 across the width of the protector 40. The concentric outer portion 70 extends downwardly below the horizontal plane 20. The protector 40 does not comprise structure extending above the horizontal plane 20 once the seal 80 structure is removed (in some embodiments, the structural components of the seal 80 may extend above horizontal plane 20 when the seal 80 is still in place). The overall length of outer portion 70 is selected such that the consumer's mouth and teeth are protected from the bottle 22.

The enclosure's inner surface 72 is designed to sufficiently engage the outer surface of the bottle 28 to maintain the enclosure 40 in place on the bottle when in use, and to create a seal between the sleeve lip underside 73*b* and the top lip 28*e* of the bottle 28. As will be understood, the embodiments of the bottle enclosures 40-43 are installed on the bottles during the bottling process using customary installation procedures and techniques known in the art.

The removable seal 80 of enclosure 40 comprises seal membrane 81 having a membrane outer surface 81*a*, and a membrane inner surface 81*b*. The membrane inner surface 81*b* may be of a material (or be coated with a material) that is compatible with or otherwise inert to the contents of the sealed beverage in bottle 28. The seal membrane 80 is attached to upper lip interior edge 73*e* to form membrane interface 82. Removable seal 80 also comprises a pull ring 83 attached to membrane outer surface 81*a* to permit the consumer to open the beverage bottle to permit consumption of the beverage contained in bottle 28. There are many ways in which one of ordinary skill in the art having the benefit of the present disclosure could design such removable seal 80. For example, the membrane interface 82 could be formed much like that employed in a ring-shaped pull tab seal used on beverage cans (such as is disclosed in U.S. Pat. No. 3,349,949 (Brown et al.) which is incorporated herein by reference in its entirety). In another embodiment, membrane interface 82 comprises a material capable of withstanding any internal bottle pressure exerted from within the sealed bottle containing beverage, but capable of tearing open when pull ring 83 is pulled. For example, membrane interface 82 may be scored to facilitate opening. In another embodiment, the membrane interface 82 could be formed much like the stay-on-tab or retained ring-pull constructions currently used on beverage cans. In one embodiment, the seal membrane 81 is constructed of a stiff rubber or plastic material to provide strength to prevent the pull ring 83 from tearing away from its attachment point 84 prior to membrane 81 being fully removed at the membrane interface line 82.

It will be appreciated to those of ordinary skill in the art having the benefit of the present disclosure that the seal structure 80 and its components, may be constructed of any suitable materials to achieve the sealing desired while also permitting the seal to be opened when the consumer is ready to consume the beverage contained in the sealed bottle 28. It will also be appreciated by those of ordinary skill in the art having the benefit of the present disclosure that the cap enclosure 40 may be constructed of any suitable materials known in the art of bottle sealing, including, plastics, rubber materials, recyclable materials, biodegradable materials, etc.

FIG. 12A-2 illustrates an embodiment of the enclosure 40 employing a removable protective covering 96, such as a shrink wrap type seal, installed over the bottle top enclosure to provide a tamper proof or tamper evident seal. Any tamper proof or tamper evident seal can be employed as would be known in the art. Exemplary shrink wrap band style tamper evident seals are available from ServiPak.com, www.servipak.com/colouredshrinkbands.htm.

The embodiment of FIG. 12A-1 illustrates bottle enclosure 40 that has an interior surface 72 with contours that fit, e.g., the BUD LIGHT® bottle neck finish area 28*b* (and other bottles with similar bottle neck finish areas). FIG. 12A-3 illustrates a bottle top enclosure and tooth protector combination 41 illustrating where the interior contour or profile 172 of the bottle top enclosure is customized to fit the exterior contour or profile of, e.g., a COORS LIGHT® bottle neck finish (e.g., FIG. 8) (and other bottles with similar bottle neck finish). It will be appreciated that the enclosures and protectors of the present invention can be designed to accommodate any bottle neck and bottle neck finish configuration, and those presented herein are merely examples.

Referring now to FIGS. 15, 15A, 15B, 15C, and 16 there is depicted an alternative enclosure embodiment 42 similar to that of enclosure 40 (e.g., FIGS. 12A and 12A-1), except featuring internal reinforcement structures, 85*a*, 85*b*, 86*a*, 86*b*, e.g., made from metal or other hard or stiff materials that can provide strengthening and stiffening, such as harder plastics, ceramics, metals and other synthetic materials. Similar numbering as with enclosure 40 will be used with enclosure 42. More particularly, the seal 80 may employ a reinforcement layer 85*b* within seal membrane 81. This reinforcement layer 85*b* could also be attached to reinforcement 85*a* within the pull ring attachment point 84. If desired, reinforcement material 85*c* may also be used within the pull ring 83. Similarly, concentric reinforcement 86*a*, 86*b* could also be embedded within enclosure outer portion 70 to provide additional support. Referring also to FIG. 15A, in one embodiment, membrane reinforcement 85*b* forms an integral part of the removable seal structure at point 85*d* around membrane interface 82 and is connected with concentric reinforcement 86*a* at point 86*c*. Preferably, the corner area 86*d* of concentric reinforcement 86*a* is thicker or otherwise strengthened to avoid shearing. In other words, as a nominal force is exerted as the pull ring 83 is pulled upward to open the seal 80 along the membrane interface or shear/tear line 82, there will be a bending moment exerted upwards on the area of the upper lip interior edge 73*e*. As such, to avoid upward bending of support structure 86*c*, it is preferred to design concentric structural support area 86*a* with sufficient cross section or section modulus to avoid any shear or bending at any location other than along the membrane interface or shear/tear line 82. In one embodiment, the upper lip interior edge 73*e* extends slightly radially inward to cover the tear line 82 once the membrane 81 has been removed. One of ordinary skill in the art having the benefit of the present disclosure could employ various fabrication techniques and materials to achieve the desired seal while also permitting the seal to later be opened while maintaining the outer covering 70 and 73 to remain intact to protect the teeth of the consumer consuming the beverage from the bottle 28.

FIG. 15B shows the removable pull tab top enclosure 42 partially opened, where the seal 80 has been partially opened along membrane interface or tear line 82. FIG. 15C shows the removable pull tab top enclosure 42 fully opened with the seal 80 completely removed to permit the consumer to drink the contents of bottle 28 as the contents flow through bottle mouth 28*g* and through enclosure opening 74. Once the membrane 80 of enclosure 42 has been fully removed, then there remains attached to the top of the bottle a tooth protector providing cushioning outer surfaces 71*c*, 73 to protect the consumers teeth from adversely impacting the traditionally hard materials used to fabricate beverage bottles, such as glass, ceramics, hard plastics and metals.

Referring now to FIG. 17, there is illustrated an alternative embodiment of the device 40 of FIG. 12A. In this embodiment of an enclosure 43, membrane structure 180 is mounted in a recessed position relative to the top 71*a* of the device 43. In this embodiment, much like with the embodiment of FIG. 1 and FIG. 2, the enclosure 43 employs an outer concentric section 70, an inner concentric section 111 and a top section 73. The top section 73 connects the top of the outer section 70 to the top of the inner section 111 proximate the device top end 71*a*. The membrane seal 81 is connected to the lower end of inner concentric section 111 at membrane interface or tear/shear 82. When the seal device 180 is removed, the protective outer coatings 71*c*, 73 remain to protect the consumer's teeth from adversely impacting the top section of the bottle 28.

Referring now to FIG. 18A there is illustrated a pull top bottle enclosure 44 according to another embodiment of the present disclosure for sealing a beverage bottle 28 containing liquid beverage, and providing a removable seal 280 to permit access to the contents of the bottle 28. In this embodiment, the structure of the enclosure 44 is similar to the internal reinforcement structure 85*a*, 85*b*, 85*c*, 85*d*, 86*a*, 86*b*, 86*c* and 86*d* regarding enclosure 42 described above (e.g., FIG. 15). In this enclosure 44, a concentric crowning type enclosure is attachable to the bottle neck end during the bottling process. The enclosure 44 contains a concentric outer member 270 having a top end 271*a* and lower end 271*b* and inner surface 272 and outer surface 271*c*. The bottle top enclosure 44 has an internal profile that mates with the bottle upper end 28*c* to permit installing on the bottle using all customary installation techniques known in the art, including, e.g., shrink fit, snap on fit, adhering with adhesive, crimping, threaded connections, etc.

The bottle top enclosure 44 according to this embodiment generally comprises a structure for insertion over the top of a beverage bottle 28 to be sealed after filling with beverage, and comprises a generally vertically-oriented outer sleeve member 270. Outer member 270 generally corresponds to the vertically-oriented bottle top section or bottle head section 28*c* or attachment zone. Outer member 270 may be coated with a protective coating (not shown) for protecting a person's teeth from contacting the bottle upper lip 28*e* if desired). Enclosure 44 also has a top end 271*a* and a bottom end 271*b*. The bottle enclosure 44 also comprises an inner surface 272 for engaging the outer surface of the bottle 28 to permit sealing the bottle once the bottle has been filled with beverage and an outer surface 271*c*. Enclosure 44 further comprises a concentric horizontally-oriented protector upper lip 273 located at the top end 271*a* of the outer surface upper end (and attached thereto) and extending inwardly to a width sufficient to cover (or substantially cover) the width of the bottle upper lip 28*e* and to create an upper opening 274 that is approximately or substantially the same opening size as the opening of the bottle mouth 28*g* when the seal 280 is removed (see, e.g., FIG. 15C for an example embodiment illustrating the seal 80 removed). More particularly, upper lip 273 comprises: an upper lip top side 273*a* (which may be coated with a protective coating (not shown) for protecting a person's teeth from contacting the bottle upper lip 28*e* if desired), an upper lip underside 273*b* for creating a seal with bottle upper lip 28*e*, an upper lip edge height defined as the distance between the upper lip top side 273*a* and the upper lip underside 273*b*, and an upper lip interior edge 273*e* defining the enclosure upper opening 274. The height is substantially uniform along the top portion 273. The outer portion 270 and top portion or lip 273 respectively may be coated with a cushioning material (not shown) to protect the consumer's teeth from the top part of the neck and top edge of the bottle 28 when the tooth protector is installed over the top of the bottle.

The concentric outer portion 270 defines an overall width or outer annular diameter (like 58 in FIG. 4) across the top portion 273 of the enclosure 44. The upper lip top side 273*a* forms a horizontal plane 20 across the width of the enclosure 44. The concentric outer portion 270 extends downwardly below the horizontal plane 20. The protector 40 does not comprise structure extending above the horizontal plane 20 once the seal 280 structure is removed (in some embodiments, the structural components of the seal 280 may extend above horizontal plane 20 when the seal 280 is still in place). The overall length of outer portion 270 is selected to facilitate attachment of the enclosure 44 to the top of the bottle.

The enclosure's inner surface 272 is designed to sufficiently engage the outer surface of the bottle 28 to maintain the enclosure 44 in place on the bottle when in use, and to create a seal between the sleeve lip underside 273*b* and the top lip 28*e* of the bottle 28. As will be understood, the bottle enclosure 44 is installed on the bottles during the bottling process using customary installation procedures and techniques known in the art.

The removable seal 280 of enclosure 44 comprises seal membrane 281 having a membrane outer surface 281*a*, and a membrane inner surface 281*b*. The membrane inner surface may be of a material (or be coated with a material) that is compatible with or otherwise inert to the contents of the sealed beverage in bottle 28. The seal membrane 281 is attached to upper lip interior edge 273*e* to form membrane interface 282. Removable seal 280 also comprises a pull ring 283 attached to membrane outer surface 281*a* to permit the consumer to open the beverage bottle to permit consumption of the beverage contained in bottle 28. There are many ways in which one of ordinary skill in the art having the benefit of the present disclosure could design such removable seal 280. For example, the membrane interface 282 could be formed much like that employed in a ring-shaped pull tab seal used on beverage cans (such as is disclosed in U.S. Pat. No. 3,349,949 (Brown et al.) which is incorporated herein by reference in its entirety). In another embodiment, membrane interface 282 comprises a material capable of withstanding any internal bottle pressure exerted from within the sealed bottle containing beverage, but capable of tearing open when pull ring 283 is pulled. For example, membrane interface 282 may be scored to facilitate opening. In another embodiment, the membrane interface 282 could be formed much like the stay-on-tab or retained ring-pull constructions currently used on beverage cans. In one embodiment, the seal membrane 281 is constructed of a stiff or hard rubber or plastic material (or variable stiffness thereof) to provide strength to prevent the pull ring 283 from tearing away from its attachment point 284 prior to membrane 281 being fully removed at the membrane interface line 282.

Reinforcement material 285*b* could also be added to membrane 281 and be attached to reinforcement 285*a* within the pull ring attachment point 284. If desired, reinforcement material 285*c* may also be used within the pull ring 283. In one embodiment, membrane reinforcement 285*b* forms an integral part of the removable seal structure at point 285*d* around membrane interface 282 and is connected with concentric structure 286*a* (i.e., at point 286*c*/upper lip interior edge 273*e*). Preferably, the corner area 286*d* of concentric structure 286*a* is thicker or otherwise strengthened to avoid shearing. In other words, as a nominal force is exerted as the pull ring 283 is pulled upward to open the seal 280 along the membrane interface or shear/tear line 282, there will be a bending moment exerted upwards on the area of the upper lip interior edge 273*e*. As such, to avoid upward bending of support structure 286*c*, it is preferred to design concentric structural support area 286*a* with sufficient cross section or section modulus to avoid any shear or bending at any location other than along the membrane interface or shear/tear line 282. One of ordinary skill in the art having the benefit of the present disclosure could employ various fabrication techniques and materials to achieve the desired seal while also permitting the seal to later be opened while maintaining the outer covering 270 and 273 to remain intact.

It will be appreciated to those of ordinary skill in the art having the benefit of the present disclosure that the seal structure 280 and its components, may be constructed of any suitable materials to achieve the sealing desired while also permitting the seal to be opened when the consumer is ready to consume the beverage contained in the sealed bottle 28. It will also be appreciated by those of ordinary skill in the art having the benefit of the present disclosure that the cap enclosure 44 may be constructed of any suitable materials known in the art of bottle sealing, including, plastics, rubber materials, recyclable materials, biodegradable materials, metals, etc.

Referring now to FIG. 18C, there is illustrated an alternative embodiment of the device 44 of FIG. 18A. In this embodiment of an enclosure 45, membrane structure 380 is mounted in a recessed position relative to the top 271*a* of the device 45. In this embodiment, much like with the embodiment of FIG. 1 and FIG. 2, the enclosure 45 employs an outer concentric section 270, an inner concentric section 311 and a top section 273. The top section 373 connects the top of the outer section 270 to the top of the inner section 311 proximate the device top end 271*a*. The membrane seal 281 is connected to the lower end of inner concentric section 311 at membrane interface or tear/shear 282.

Referring now to FIGS. 20A, 20B, and 20C, tooth protector sleeve 30 may also be modified to display advertising or other content on the outer surfaces 51*c*. For example, FIG. 20A displays a logo 90 printed on a desired location on the outer surface of the tooth protector sleeve 30. FIG. 20B displays a logo 92 recessed into a desired location on the outer surface of the tooth protector sleeve 30. FIG. 20C displays a logo 94 in raised format on a desired location on the outer surface of the tooth protector sleeve 30. It will be understood that the actual content of the "logo" could be any type of content, whether textual, graphical or both. It is envisioned that sleeve protectors could be custom made to fit any desired brand of bottle or brand of bottled beverage, and that the advertising, promotional or other content 90, 92, 94 could be tailored to that particular brand, or to targeted consumers. For example, the tooth protector bottle sleeve 34 (FIG. 7) is customized for a particular bottle profile, such as here, for example, a BUD LIGHT® brand beer bottle (Anheuser-Busch Incorporated) and could contain advertisement, logos or trademarks of Anheuser-Busch Incorporated relevant to this brand or their target consumers. Similarly, the tooth protector bottle sleeve 35 (FIG. 8) is customized for a particular bottle profile, such as here, for example, a COORS LIGHT® brand beer bottle (MillerCoors LLC) and could contain advertisement, logos or trademarks of MillerCoors LLC relevant to this brand or their target consumers. Furthermore, the protector sleeves of the present invention could also be used as promotional and marketing products for beverage companies, or other restaurants, bars, clubs, casinos, racing events, sports venues, fitness centers, stores, etc. where beverages are sold or consumed, and could contain promotional information about such venues or companies. Additionally, the bottle sleeves of the present invention can also contain information about various fundraising events or charitable organizations, schools, universities, corporations, etc. Likewise, cap enclosure 40 (FIGS. 19A, 19B, 19C) could likewise be adorned with desired logos or advertising content 90*a*, 90*b*, 90*c*. Further, such advertising content could be employed on any of the sleeves or enclosures of the present disclosure.

The protector sleeves of the present invention are designed to be reusable. In the embodiments secured using mated grooves, channels, and the like to create an interference fit between the protector and the bottle, these protectors snap into place and will remain in place during use (i.e., drinking from the bottle), and can then be snapped back off for reuse, or in the case of a threaded connection, they can be screwed on and off the bottle as desired. All of the protector sleeves of the present invention can contain a clasp, clip or other mechanism 16 to permit attachment of the sleeve protector to a keychain, neck chain or similar structure.

The protector sleeve of the present invention can be used on any beverage bottle style, whether long neck, short neck, wide mouth, threaded, jar-style or the like. The protectors create a sealed surface at the interface of the protector top surface and the bottle top edge. It will be apparent to those of ordinary skill in the art having the benefit of the present disclosure that many materials can be used to fabricate the protector sleeves and bottle enclosures of the present invention. For those protectors employing a skirt section, it is desirable that the skirt material be flexible, stretchable material to permit the skirt to engage the outer surface of the bottle in a snug relationship to minimize movement of the protector while in use and to maintain a tight seal at the top bottle edge. For those embodiments employing threaded connections on the protector sleeve, any matching thread types can be employed to secure the protector sleeve to the threaded connection on the bottle.

All references referred to herein are incorporated herein by reference. While the apparatus, systems and methods of this invention have been described in terms of preferred or illustrative embodiments, it will be apparent to those of skill in the art that variations may be applied to the process and system described herein without departing from the concept and scope of the invention. All such similar substitutes and modifications apparent to those skilled in the art are deemed to be within the scope and concept of the invention. Those skilled in the art will recognize that the method and apparatus of the present invention has many applications, and that the present invention is not limited to the representative examples disclosed herein. Moreover, the scope of the present invention covers conventionally known variations and modifications to the system components described herein, as would be known by those skilled in the art.

What is claimed is:

1. A reusable tooth protector comprising a monolithic structure for attachment to and removal from a top of an opened, beverage-containing bottle or other beverage drinking container to prevent potential damage to a consumer's teeth on impact with the bottle or container neck during use, the opened bottle or container having a neck section comprising a top edge having a circumference defining a mouth opening into the bottle or container and a top outer section extending downwardly from the top edge, the bottle or container neck top outer section further comprising a plurality of circumferential protrusions for engaging the protector defining a bottle or container neck outer surface profile, the tooth protector comprising:

an open-ended concentric outer sleeve having an outer surface portion, formed from a soft material to provide cushioning for the teeth, with top end and bottom end, an internal surface comprising a plurality of spaced apart circumferential grooves that are substantially parallel to the top end for mating with the bottle or container top outer section circumferential protrusions, said internal surface not being threaded, said internal surface comprising a harder material than the outer surface soft material to provide structural support, a top lip portion capable of extending around the entire circumference of the bottle or container top edge and extending radially inwardly from the top end of the concentric outer sleeve a distance sufficient to cover the bottle or container top edge, the top lip having an outer edge defining an aperture opening coaxial with the bottle or container mouth opening when the sleeve is attached over the bottle or container neck section, the top lip having a top side and an underside, the top lip underside creating a seal across the bottle or container top edge when the protector is attached over the bottle or container neck section, the sleeve outer surface portion defining an overall protector width, the sleeve outer surface and top lip portions respectively providing protection from the top section of the neck and the top edge of the opened bottle or container when the tooth protector is inserted over the mouth of the opened bottle or container, the sleeve top lip portion defining a horizontal plane across the width of the protector, the protector not comprising structure that extends above the horizontal plane.

2. The tooth protector of claim 1 wherein one of the plurality of circumferential protrusions comprises a circumferential flange located proximate the mouth of the bottle or container, the flange having an outer flange surface, a top flange edge and a bottom flange edge, and wherein one of the plurality of circumferential grooves mates with the circumferential flange, the one of the plurality of circumferential grooves having a top edge and a bottom edge, the groove snapping into place over the flange to secure the protector in position on the bottle or container.

3. The tooth protector of claim 1 wherein one of the plurality of circumferential protrusions comprises a circumferential bead located on the bottle or container top outer section, the bead having an outer bead surface, a top bead edge and a bottom bead edge, and wherein one of the plurality of circumferential grooves mates with the circumferential bead, the one of the plurality of circumferential grooves having a top edge and a bottom edge, the groove snapping into place over the bead to secure the protector in position on the bottle or container.

4. The tooth protector of claim 1 wherein at least one circumferential groove snaps into interference fit engagement with a corresponding one of the one or more bottle or container circumferential protrusions to secure the protector in position on the bottle or container.

5. The tooth protector of claim 1 wherein the protector internal surface comprises three circumferential grooves and the bottle or container contains three corresponding circumferential protrusions for snapping into interference fit engagement with each other to secure the protector in position on the bottle or container.

6. The tooth protector of claim 1 wherein the protector internal surface comprises a surface profile that engages, in mated relationship, the bottle or container outer surface profile.

7. The tooth protector of claim 1, wherein the tooth protector is fabricated from rubber.

8. The tooth protector of claim 1, wherein the tooth protector is fabricated from soft plastic.

9. The tooth protector of claim 1, further comprising a clip loop on the outer surface portion for attachment of the tooth protector to a keychain or similar structure.

10. The tooth protector of claim 1, further comprising advertising information displayed on the outer sleeve outer surface portion.

11. The tooth protector of claim 1, the protector not comprising structure extending into the bottle or container through the mouth opening when the protector is installed on the bottle or container.

12. The beverage bottle or container enclosure of claim 1 wherein the outer sleeve is structurally reinforced.

13. The tooth protector of claim 12 wherein the structural reinforcement is embedded within the outer sleeve.

14. The reusable tooth protector of claim 1 wherein the top lip portion extends inwardly from the top end of the concentric outer sleeve a uniform radial distance around the entire circumference of the bottle or container top edge.

15. A reusable tooth protector comprising a monolithic structure for attachment to and removal from a top of an opened, beverage-containing bottle or other beverage drinking container to prevent potential damage to a consumer's teeth on impact with the bottle or container neck during use, the opened bottle or container having a neck section comprising a top edge having a circumference defining a mouth opening into the bottle or container and a top outer section extending downwardly from the top edge, the bottle or container neck top outer section further comprising a plurality of circumferential protrusions for engaging the protector defining a bottle or container neck outer surface profile, the tooth protector comprising:

an open-ended, structurally reinforced concentric outer sleeve having an outer surface portion, formed from a soft material to provide cushioning for the teeth, with top end and bottom end, an internal surface comprising a plurality of spaced apart circumferential grooves that are substantially parallel to the top end for mating with the bottle or container top outer section circumferential protrusions, said internal surface not being threaded, wherein the concentric outer sleeve internal surface comprises a material that is harder than that of the soft outer surface portion material to provide structural support, and a top lip portion capable of extending around the entire circumference of the bottle or container top edge and extending radially inwardly from the top end of the concentric outer sleeve a distance sufficient to cover the bottle or container top edge, the top lip having an outer edge defining an aperture opening coaxial with the bottle or container mouth opening when the sleeve is attached over the bottle or container neck section, the top lip having a top side and an underside, the top lip underside creating a seal across the bottle or container top edge when the protector is attached over the bottle or container neck section, the sleeve outer surface portion defining an overall protector width, the sleeve outer surface and top lip portions respectively providing protection from the top section of the neck and the top edge of the opened bottle or container when the tooth protector is inserted over the mouth of the opened bottle or container, the sleeve top lip portion defining a horizontal plane across the width of the protector, the protector not comprising structure that extends above the horizontal plane.

* * * * *